US010580358B2

(12) United States Patent
Kuki et al.

(10) Patent No.: US 10,580,358 B2
(45) Date of Patent: Mar. 3, 2020

(54) ORGANIC EL DISPLAY DEVICE AND METHOD FOR ESTIMATING DETERIORATION AMOUNT OF ORGANIC EL ELEMENT

(71) Applicant: Sharp Kabushiki Kaisha, Sakai, Osaka (JP)

(72) Inventors: Hikaru Kuki, Sakai (JP); Asahi Yamato, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/060,427

(22) PCT Filed: Feb. 24, 2017

(86) PCT No.: PCT/JP2017/007115
§ 371 (c)(1),
(2) Date: Aug. 30, 2018

(87) PCT Pub. No.: WO2018/154712
PCT Pub. Date: Aug. 30, 2018

(65) Prior Publication Data

US 2019/0362671 A1 Nov. 28, 2019

(51) Int. Cl.
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2320/0257* (2013.01);
(Continued)

(58) Field of Classification Search
CPC ..... G09G 3/3233; G09G 3/2007; G09G 2320/0257; G09G 2320/045;
(Continued)

(56) References Cited

U.S. PATENT DOCUMENTS

2012/0154453 A1 6/2012 Yamashita et al.
2013/0176324 A1 7/2013 Yamashita et al.
(Continued)

FOREIGN PATENT DOCUMENTS

JP 2007-240805 A 9/2007
JP 2012-128146 A 7/2012
(Continued)

OTHER PUBLICATIONS

Official Communication issued in International Patent Application No. PCT/JP2017/007115, dated May 30, 2017.

*Primary Examiner* — Dennis P Joseph
(74) *Attorney, Agent, or Firm* — Keating & Bennett, LLP

(57) ABSTRACT

The disclosure has an object to achieve an organic EL display device capable of effectively inhibiting image sticking caused by deterioration of the organic EL element from occurring. An organic EL display device includes a total time deterioration amount DB holding a total time deterioration amount for each pixel, a total time deterioration amount update unit obtaining an incremental deterioration amount of the organic EL element taking into account a gray scale value, a set value in a brightness setting, and a temperature for each unit of time to add the incremental deterioration amount to the total time deterioration amount held in the total time deterioration amount DB, and an image deterioration correction unit correcting the gray scale value based on the total time deterioration amount held in the total time deterioration amount DB.

18 Claims, 26 Drawing Sheets

(52) U.S. Cl.
CPC ..... *G09G 2320/045* (2013.01); *G09G 2320/0626* (2013.01); *G09G 2320/0666* (2013.01); *G09G 2330/10* (2013.01)

(58) Field of Classification Search
CPC ..... G09G 2320/048; G09G 2320/0673; G09G 2320/0626
See application file for complete search history.

(56) References Cited

U.S. PATENT DOCUMENTS

| | | | | |
|---|---|---|---|---|
| 2015/0130863 | A1 | 5/2015 | Santo | |
| 2016/0027382 | A1* | 1/2016 | Chaji ..... | G09G 3/006 345/212 |

FOREIGN PATENT DOCUMENTS

| | | | |
|---|---|---|---|
| JP | 2013-142775 | A | 7/2013 |
| JP | 2015-118368 | A | 6/2015 |

* cited by examiner

| y | 1.53 | 9.61 | 17.07 | 23.27 | 28.51 | 33.04 | 37.07 | 40.75 | 44.19 | 47.45 | 50.54 |
|---|---|---|---|---|---|---|---|---|---|---|---|
| Δy | 0.90 | 0.83 | 0.68 | 0.57 | 0.49 | 0.43 | 0.38 | 0.36 | 0.34 | 0.32 | 0.30 |

FIG. 15

ORGANIC EL DISPLAY DEVICE AND METHOD FOR ESTIMATING DETERIORATION AMOUNT OF ORGANIC EL ELEMENT

TECHNICAL FIELD

The disclosure relates to an organic EL display device and a method for estimating a deterioration amount of an organic EL element.

BACKGROUND ART

In the past, there have been, as a display element in a display device, an electrooptic element whose luminance or transmittance is controlled depending on a voltage applied thereto, and an electrooptic element whose luminance or transmittance is controlled depending on a current flowing therein. Representative examples of the electrooptic element whose luminance or transmittance is controlled depending on a voltage applied thereto include a liquid crystal display element. Representative examples of the electrooptic element whose luminance or transmittance is controlled depending on a current flowing therein include an organic EL element. The organic EL element is also called an Organic Light-Emitting Diode (OLED). An organic EL display device using the organic EL element that is a self-luminous electrooptic element can be easily thinned, reduced in power consumption, and increased in luminance as compared with a liquid crystal display device requiring backlights, color filters and the like. Therefore, development of the organic EL display device has been aggressively advanced in recent years.

On the other hand, regarding the organic EL display device, the organic EL element deteriorates as time elapses. To be more specific, the organic EL element changes in voltage-current characteristics or decreases in light emitting efficiency as time elapses. Change in the voltage-current characteristics decreases the current flowing in the organic EL element even in a case where a voltage the same as an initial voltage is applied to the organic EL element. For this reason, a luminance gradually decreases as time elapses. Decrease in the light emitting efficiency gradually decreases the luminance even in a case where a constant current is supplied to the organic EL element. Such a deterioration degree of the organic EL element depends on a length of a lighting time period, a luminance at a lighting time or the like. For this reason, a difference is made in the deterioration degrees of organic EL elements among pixels to cause a phenomenon called "image sticking" to occur.

Therefore, a technology for inhibiting image sticking from occurring for the organic EL display device has been proposed in the past. For example, in an organic EL display device disclosed in JP 2007-240805 A and JP 2013-142775 A, a deterioration amount calculated from an input gray scale value is accumulated and the gray scale value is corrected on the basis of an accumulated value of the deterioration amount to inhibit the image sticking from occurring.

CITATION LIST

Patent Literature

PTL 1: JP 2007-240805 A
PTL 2: JP 2013-142775 A

SUMMARY OF DISCLOSURE

Technical Problem

In accordance with experiments, in a case that an organic EL element is continuously lighted (made to emit light) under a certain condition, a relationship between an elapsed time and an amount of deterioration of an organic EL element accumulated with the elapsed time (hereinafter, referred to as a "total time deterioration amount") is represented by a curved line as illustrated in FIG. 26, designated by a reference sign 91. As seen from FIG. 26, it can be understood that progression of the deterioration is moderated as time elapses. To be more specific, the relationship between the elapsed time and the total time deterioration amount is a non-linear relationship. However, in the organic EL display devices disclosed in JP 2007-240805 A and JP 2013-142775 A, the relationship between the elapsed time and the total time deterioration amount is assumed to be a liner relationship to correct a gray scale value. For this reason, correction accuracy is insufficient, which does not sufficiently inhibit the image sticking from occurring.

Therefore, the disclosure has an object to achieve an organic EL display device capable of effectively inhibiting image sticking caused by deterioration of the organic EL element from occurring.

Solution to Problem

A first aspect of the disclosure is an organic EL display device provided with multiple pixel circuits including organic EL elements, the organic EL display device including:

a deterioration amount holding unit configured to hold a deterioration amount of at least one organic EL element among the organic EL elements included in a pixel circuit among the multiple pixel circuits;

a deterioration amount update unit configured to obtain an incremental deterioration amount of the organic EL element included in the pixel circuit taking into account a gray scale value of a video signal and at least one of a set value for brightness adjustment and a temperature, and add the obtained incremental deterioration amount to the deterioration amount held in the deterioration amount holding unit; and a gray scale value correction unit configured to correct the gray scale value, based on the deterioration amount held in the deterioration amount holding unit when generating the video signal from an input signal.

In a second aspect the disclosure according to the first aspect of the disclosure, the deterioration amount update unit is further configured to obtain the incremental deterioration amount of the organic EL element included in the pixel circuit, based on a deterioration coefficient and the deterioration amount held in the deterioration amount holding unit, the deterioration coefficient being obtained by multiplying a gray scale correction coefficient determined based on the gray scale value of the video signal, a brightness correction coefficient determined based on the set value for brightness adjustment, and a temperature correction coefficient determined based on the temperature together.

In a third aspect of the disclosure according to the first aspect of the disclosure, the deterioration amount update unit is further configured to obtain the incremental deterioration amount of the organic EL element included in the pixel circuit, based on a deterioration coefficient and the deterioration amount held in the deterioration amount holding unit, the deterioration coefficient being obtained by multiplying a gray scale correction coefficient determined based on the gray scale value of the video signal and a brightness correction coefficient determined based on the set value for brightness adjustment together.

In a fourth aspect of the disclosure according to the first aspect of the disclosure, the deterioration amount update unit is further configured to obtain the incremental deterioration amount of the organic EL element included in the pixel circuit, based on a deterioration coefficient and the deterioration amount held in the deterioration amount holding unit, the deterioration coefficient being obtained by multiplying a gray scale correction coefficient determined based on the gray scale value of the video signal and a temperature correction coefficient determined based on the temperature together.

In a fifth aspect of the disclosure according to any one of the second to fourth aspects of the disclosure, the deterioration amount update unit includes an incremental deterioration amount calculation look-up table holding a relationship between the deterioration amount and the incremental deterioration amount, the incremental deterioration amount calculation look-up table being referred to in obtaining the incremental deterioration amount of the organic EL element included in the pixel circuit.

In a sixth aspect of the disclosure according to the fifth aspect of the disclosure, the relationship held in the incremental deterioration amount calculation look-up table is expressed by a following equation:

$$\Delta y = g(y)$$

where, Δy represents the incremental deterioration amount, y represents the deterioration amount, and g represents a function with y as an argument.

In a seventh aspect of the disclosure according to the sixth aspect of the disclosure, the deterioration amount update unit is further configured to refer to the incremental deterioration amount calculation look-up table to obtain the incremental deterioration amount of the organic EL element included in the pixel circuit by using a following equation:

$$\Delta y' = K \cdot g((1/K) \cdot y)$$

where, Δy' represents the incremental deterioration amount of a target organic EL element, K represents the deterioration coefficient corresponding to the target organic EL element, and y represents the deterioration amount of the target organic EL element held in the deterioration amount holding unit.

In an eighth aspect of the disclosure according to the first aspect of the disclosure, at the deterioration amount update unit, obtaining the incremental deterioration amount of the organic EL element included in the pixel circuit further includes taking into account a time having required to fabricate the organic EL element.

In a ninth aspect of the disclosure according to the first aspect of the disclosure, the gray scale value correction unit is further configured to correct the gray scale value of the video signal corresponding to the pixel circuit including the organic EL element to be smaller as compared with a gray scale value of the input signal, as the deterioration amount of the organic EL element is relatively smaller.

In a tenth aspect of the disclosure according to the first aspect of the disclosure, the gray scale value correction unit is further configured to correct the gray scale value of the video signal corresponding to the pixel circuit including the organic EL element to be larger as compared with a gray scale value of the input signal, as the deterioration amount of the organic EL element is relatively larger.

In an eleventh aspect of the disclosure according to the first aspect of the disclosure, the deterioration amount holding unit is further configured to hold the deterioration amount of the organic EL element included in the pixel circuit for each of all the multiple pixel circuits.

In a twelfth aspect the disclosure according to the first aspect of the disclosure, wherein data of the deterioration amount held in the deterioration amount holding unit includes data for each group, the group including P pixel circuits (P is an integer equal to or greater than two).

In a thirteenth aspect of the disclosure according to the twelfth aspect of the disclosure, when focusing on pixel circuits corresponding to any one color, two pixel circuits adjacent to each other belong to groups different from each other.

In a fourteenth aspect of the disclosure according to the thirteenth aspect of the disclosure, multiple pixel circuits arranged in a line in a direction in which a data line extends are defined as a pixel line, any two pixel lines adjacent to each other are defined as a first pixel line and a second pixel line, and when focusing on a group including two or more pixel circuits included in the first pixel line and corresponding to a first color, two pixel circuits belong to different groups, the two pixel circuits being included in the second pixel line, corresponding to a second color different from the first color, and being adjacent to two pixel circuits that belongs to the focused group and are arranged on one end side and the other end side of the first pixel line.

In a fifteenth aspect of the disclosure according to the thirteenth aspect of the disclosure, multiple pixel circuits arranged in a line in a direction in which a scanning signal line extends are defined as a pixel line, any two pixel lines adjacent to each other are defined as a first pixel line and a second pixel line, and when focusing on a group including two or more pixel circuits included in the first pixel line, two pixel circuits included in the second pixel line belong to different groups, two pixel circuits belong to different groups, the two pixel circuits being included in the second pixel line and being adjacent to two pixel circuits that belongs to the focused group and are arranged on one end side and the other end side of the first pixel line.

A sixteenth aspect of the disclosure is a method for estimating a deterioration amount of an organic EL element included in a pixel circuit of an organic EL display device, the method including:

a parameter data acquiring step of acquiring a gray scale value of a video signal and at least one of a set value for brightness adjustment and a temperature, as parameter data;

an incremental deterioration amount calculation step of obtaining an incremental deterioration amount of the organic EL element included in the pixel circuit taking into account the parameter data; and a deterioration amount calculation step of obtaining a current deterioration amount, for the organic EL element included in the pixel circuit, by adding a deterioration amount held in a deterioration amount holding unit prepared in advance to the incremental deterioration amount obtained in the incremental deterioration amount calculation step.

In a seventeenth aspect of the disclosure according to the sixteenth aspect of the disclosure, the parameter data acquiring step includes:

a gray scale value acquiring step of acquiring the gray scale value of the video signal;

a set value acquiring step of acquiring the set value for brightness adjustment; and a temperature acquiring step of acquiring the temperature.

In an eighteenth aspect of the disclosure according to the seventeenth aspect of the disclosure, the method further includes, a gray scale correction coefficient acquiring step of acquiring a gray scale correction coefficient determined, based on the gray scale value acquired in the gray scale value acquiring step;

a brightness correction coefficient acquiring step of acquiring a brightness correction coefficient determined, based on the set value acquired in the set value acquiring step; and a temperature correction coefficient acquiring step of acquiring a temperature correction coefficient determined, based on the temperature acquired in the temperature acquiring step, wherein the deterioration amount calculation step includes obtaining the incremental deterioration amount of the organic EL element included in the pixel circuit, based on a deterioration coefficient obtained by multiplying the gray scale correction coefficient, the brightness correction coefficient, and the temperature correction coefficient together, and the deterioration amount held in the deterioration amount holding unit.

In a nineteenth aspect of the disclosure according to the eighteenth aspect of the disclosure, wherein the deterioration amount calculation step further includes referring an incremental deterioration amount calculation look-up table holding a relationship between the deterioration amount and the incremental deterioration amount to obtain the incremental deterioration amount of the organic EL element included in the pixel circuit.

In a twentieth aspect of the disclosure according to the nineteenth aspect of the disclosure, the relationship held in the incremental deterioration amount calculation look-up table is expressed by a following equation:

$$\Delta y = g(y)$$

where, Δy represents the incremental deterioration amount, y represents the deterioration amount, and g represents a function with y as an argument.

In a twenty-first aspect of the disclosure according to the twentieth aspect of the disclosure, wherein the deterioration amount calculation step further includes referring the incremental deterioration amount calculation look-up table, to obtain the incremental deterioration amount of the organic EL element included in the pixel circuit by a following equation:

$$\Delta y' = K \cdot g((1/K) \cdot y)$$

where, Δy' represents the incremental deterioration amount of a target organic EL element, K represents the deterioration coefficient corresponding to the target organic EL element, and y represents the deterioration amount of the target organic EL element held in the deterioration amount holding unit.

In a twenty-second aspect of the disclosure according to the sixteenth aspect of the disclosure, wherein the parameter data acquiring step further includes acquiring a time having required to fabricate the organic EL element as the parameter data.

Advantageous Effects of Invention

According to the first aspect of the disclosure, the organic EL display device is provided with the deterioration amount holding unit holding the data of the deterioration amount of the organic EL element for each pixel. The gray scale value is corrected based on the data of the deterioration amount held in the deterioration amount holding unit. The organic EL display device is further provided with the deterioration amount update unit updating the data of the deterioration amount held in the deterioration amount holding unit. In updating the deterioration amount by the deterioration amount update unit, the incremental deterioration amount is obtained taking into account the gray scale value and at least one of the set value for brightness adjustment and the temperature. The incremental deterioration amount obtained in this way is used to update the deterioration amount, allowing the deterioration amount of the organic EL element to be accurately obtained at each time point. As a result, the gray scale value is corrected, based on the data of the deterioration amount accurately obtained, which also improves correction accuracy of the gray scale value. Therefore, the image sticking is effectively inhibited from occurring. As described above, the organic EL display device is achieved which can effectively inhibit the image sticking caused by the deterioration of the organic EL element from occurring.

According to the second aspect of the disclosure, all of the gray scale value, the set value for brightness adjustment, and the temperature are taken into account to obtain the incremental deterioration amount of the organic EL element. This allows the deterioration amount of the organic EL element to be extremely accurately obtained at each time point. Therefore, the image sticking caused by the deterioration of the organic EL element is extremely effectively inhibited from occurring.

According to the third or fourth aspect of the disclosure, the same effect as the first aspect of the disclosure can be achieved.

According to any of the fifth to seventh aspects of the disclosure, the incremental deterioration amount of the organic EL element included in each pixel circuit can be easily obtained while the organic EL display device operates.

According to the eighth aspect of the disclosure, the incremental deterioration amount of the organic EL element is obtained with further taking into account a length of the fabrication time of the organic EL element. This allows the deterioration amount of the organic EL element to be more accurately obtained at each time point. Therefore, the correction accuracy of the gray scale value is improved, which allows the image sticking caused by the deterioration of the organic EL element to be more effectively inhibited from occurring.

According to the ninth aspect of the disclosure, the same effect as the first aspect of the disclosure can be achieved.

According to the tenth aspect of the disclosure, the gray scale value is heightened according to the deterioration amount of the organic EL element. The gray scale values are corrected in such a way when an image generally low in luminance (an image of which gray scale values involves no overflow even in a case where the gray scale values are corrected to be heightened) is displayed, which enables displaying at target luminances in all pixels.

According to the eleventh aspect of the disclosure, the data of the deterioration amount is held for each of all the multiple pixel circuits, allowing the gray scale values to be accurately corrected.

According to the twelfth aspect of the disclosure, the data of the deterioration amount is held for every multiple pixel circuits, allowing a required amount of memory to be reduced.

According to the thirteenth aspect of the disclosure, a block noise when an image is displayed is inhibited from being generated.

According to the fourteenth or fifteenth aspect of the disclosure, the block noise when an image is displayed is more effectively inhibited from being generated.

According to the sixteenth aspect of the disclosure, in estimating the deterioration amount of the organic EL element, the incremental deterioration amount is obtained taking into account the gray scale value and at least one of the set value for brightness adjustment and the temperature. The incremental deterioration amount obtained in this way is used to obtain the current deterioration amount, allowing the current deterioration amount to be accurately obtained. Moreover, the gray scale value is corrected based on the data of the deterioration amount obtained accurately in this way, which allows the image sticking caused by the deterioration of the organic EL element to be effectively inhibited from occurring.

According to the seventeenth or eighteenth aspect of the disclosure, all of the gray scale value, the set value for brightness adjustment, and the temperature are taken into account to obtain the incremental deterioration amount of the organic EL element. This allows the deterioration amount of the organic EL element to be extremely accurately obtained.

According to any of the nineteenth to twenty first aspects of the disclosure, the incremental deterioration amount of the organic EL element included in each pixel circuit can be easily obtained while the organic EL display device operates.

According to the twenty second aspect of the disclosure, the incremental deterioration amount of the organic EL element is obtained further taking into account the length of the fabrication time of the organic EL element. This improves estimation accuracy for the deterioration amount of the organic EL element.

BRIEF DESCRIPTION OF DRAWINGS

FIG. 15 is a diagram for describing a relationship between a total time deterioration amount and an incremental deterioration amount per unit of time in the above embodiment.

DESCRIPTION OF EMBODIMENTS

Embodiments of the disclosure will be described below with reference to the accompanying drawings. Assume that i and j each represent an integer equal to or greater than 2, m represents an integer from 1 to i, and n represents an integer from 1 to j in the following description.

1. Entire Configuration

Figure 2:
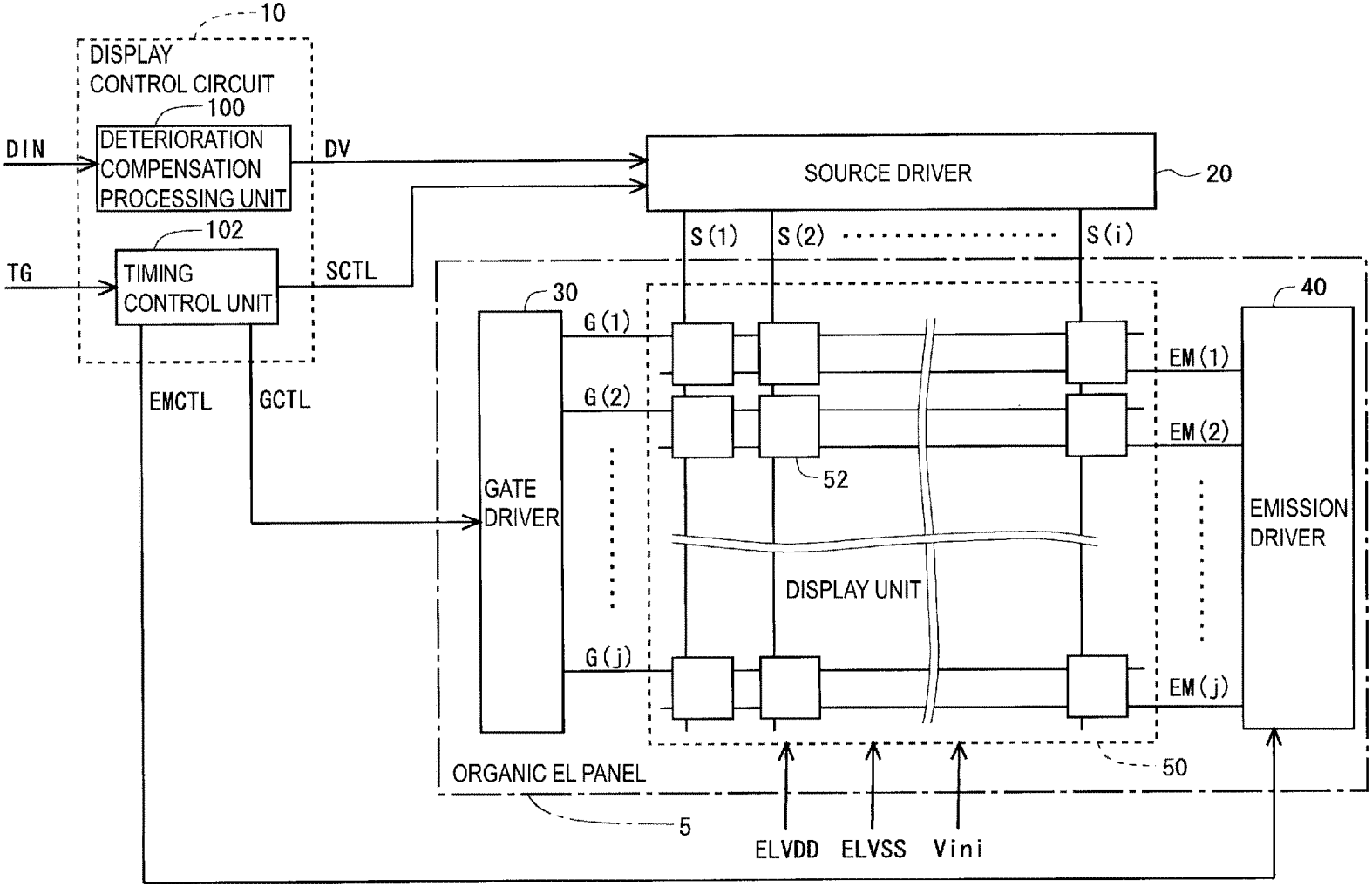
FIG. 2 is a block diagram illustrating an entire configuration of the organic EL display device according to the above embodiment.

FIG. 2 is a block diagram illustrating an entire configuration of an organic EL display device according to an embodiment of the disclosure. The organic EL display device includes a display control circuit 10, a source driver (data line driving circuit) 20, a gate driver (scanning signal line driving circuit) 30, an emission driver (light emission control line driving circuit) 40, and a display unit 50. In the embodiment, the gate driver 30 and the emission driver 40 are formed within an organic EL panel 5 including the display unit 50. To be more specific, the gate driver 30 and the emission driver 40 are formed to be monolithic. However, a configuration may also be used in which the gate driver 30 and the emission driver 40 are not formed to be monolithic.

In the display unit 50, i data lines S(1) to S(i) and j scanning signal lines G(1) to G(j) orthogonal to these data lines are arranged. In the display unit 50, j light emission control lines EM(1) to EM(j) to correspond to j scanning signal lines G(1) to G(j) on a one-to-one basis are also arranged. The scanning signal lines G(1) to G(j) and the light emission control lines EM(1) to EM(j) are parallel to each other. Further, the display unit 50 is provided with i×j pixel circuits 52 to correspond to intersections between i data lines S(1) to S(i) and j scanning signal lines G(1) to G(j). In this way, i×j pixel circuits 52 are provided to form a pixel matrix of i columns×j rows on the display unit 50. In the following description, scanning signals applied to j scanning signal lines G(1) to G(j) may be also designated by reference signs G(1) to G(j), light emission control signals applied to j light emission control lines EM(1) to EM(j) may be also designated by reference signs EM(1) to EM(j), and data signals applied to data line S(1) to S(i) may be also designated by reference sign S(1) to S(i).

In the display unit 50, power source lines not illustrated which are common to the pixel circuits 52 are also arranged. To be more specific, a power source line which supplies a high level power supply voltage ELVDD for driving organic EL elements (hereinafter, referred to as a "high level power source line"), a power source line which supplies a low level power supply voltage ELVSS for driving the organic EL elements (hereinafter, referred to as a "low level power source line"), and a power source line which supplies an initialization voltage Vini (hereinafter, referred to as an "initialization power source line") are arranged. The high level power supply voltage ELVDD, the low level power supply voltage ELVSS, and the initialization voltage Vini are supplied from a power source circuit not illustrated.

A description is given below of operations of the components illustrated in FIG. 2. As illustrated in FIG. 2, the display control circuit 10 includes a deterioration compensation processing unit 100, and a timing control unit 102. The display control circuit 10 is given an input image signal DIN and a timing signals group (horizontal synchronizing signal, vertical synchronizing signal, and the like) TG from outside. The deterioration compensation processing unit 100 corrects a gray scale value of the input image signal DIN such that the deterioration of the organic EL element is compensated, and outputs a digital video signal DV indicating the corrected gray scale value. Note that the deterioration compensation processing unit 100 is described later in detail. The timing control unit 102 outputs, on the basis of the timing signals group TG, a source control signal SCTL controlling an operation of the source driver 20, a gate control signal GCTL controlling an operation of the gate driver 30, and an emission driver control signal EMCTL controlling an operation of the emission driver 40. The source control signal SCTL includes a source start pulse signal, a source clock signal, a latch strobe signal, and the like. The gate control signal GCTL includes a gate start pulse signal, a gate clock signal, and the like. The emission driver control signal EMCTL includes an emission start pulse signal, an emission clock signal, and the like.

The source driver 20 is connected with i data lines S(1) to S(i). The source driver 20 receives the digital video signal DV and source control signal SCTL output from the display control circuit 10, and applies the data signals to i data lines S(1) to S(i). The source driver 20 includes an i-bit shift register, a sampling circuit, a latch circuit, i D/A converters, and the like which are not illustrated. The shift register includes i registers connected with each other in a cascade manner. The shift register sequentially transfers a pulse of a source start pulse signal supplied to a first stage register from an input terminal to an output terminal on the basis of the source clock signal. In response to this pulse transferring, sampling pulses are output from respective stages of the shift register. The sampling circuit stores the digital video signal DV on the basis of the sampling pulses. The latch circuit gets and holds the digital video signal DV for one row stored in the sampling circuit in accordance with the latch strobe signal. The D/A converters are provided to correspond to the data lines S(1) to S(i). The D/A converters convert components of the digital video signal DV held by the latch circuit into analog voltages. The converted analog voltages are simultaneously applied to as data signals to all the data lines S(1) to S(i).

The gate driver 30 is connected with j scanning signal lines G(1) to G(j). The gate driver 30 includes a shift register, a logic circuit, and the like. The gate driver 30 drives j scanning signal lines G(1) to G(j) on the basis of the gate control signal GCTL output from the display control circuit 10.

The emission driver 40 is connected with j light emission control lines EM(1) to EM(j). The emission driver 40 includes a shift register, a logic circuit, and the like. The emission driver 40 drives j light emission control lines EM(1) to EM(j) on the basis of the emission driver control signal EMCTL output from the display control circuit 10.

As described above, i data lines S(1) to S(i), j scanning signal lines G(1) to G(j), and j light emission control lines EM(1) to EM(j) are driven to display an image on the basis of the input image signal DIN on the display unit 50. At this time, the deterioration compensation processing unit 100 in the display control circuit 10 corrects the gray scale values according to a deterioration degree of the organic EL elements to compensate the deterioration of the organic EL elements. This inhibits the image sticking caused by the deterioration of the organic EL elements from occurring.

2. Configuration and Operation of Pixel Circuit

Figure 3:
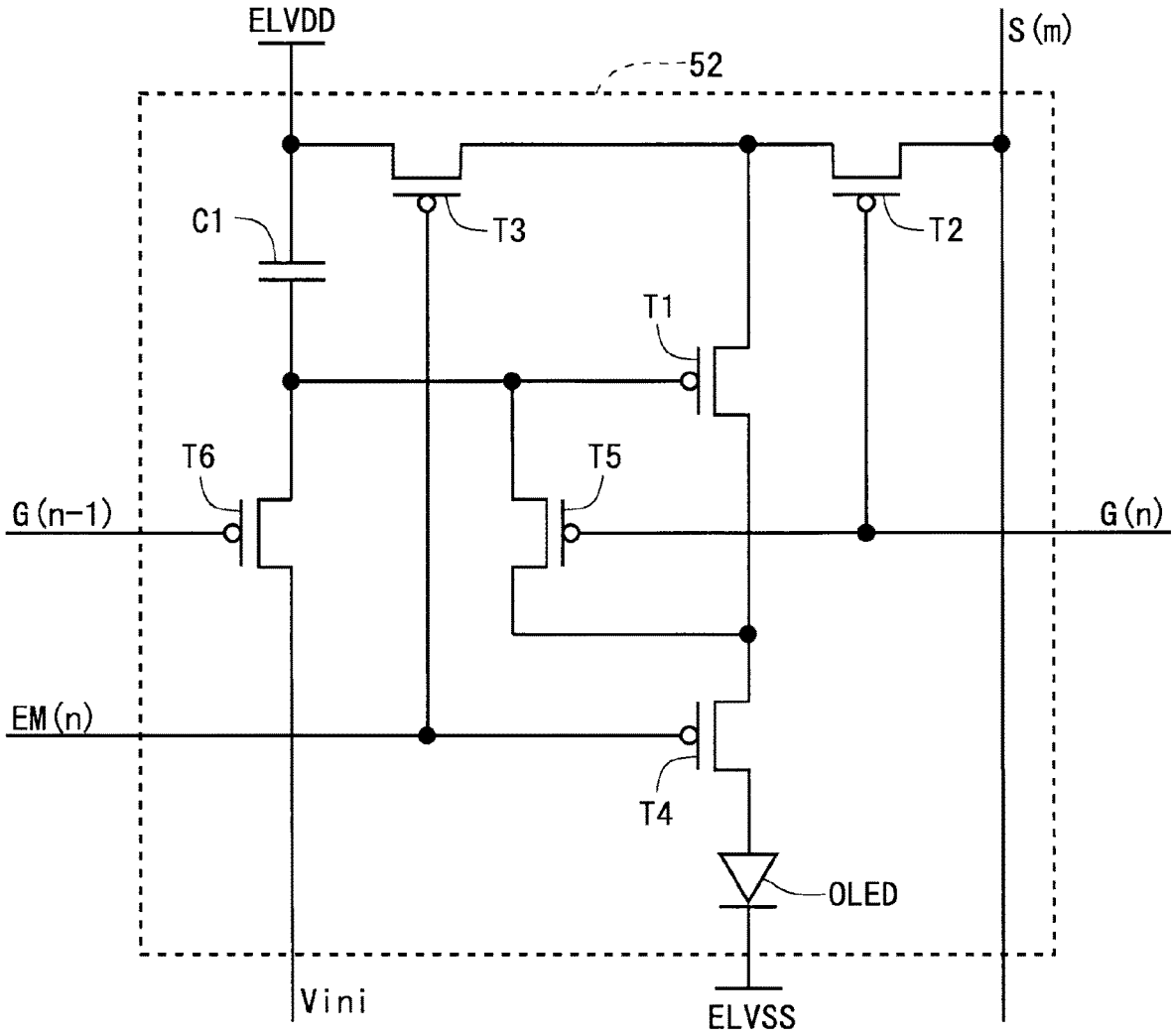
FIG. 3 is a circuit diagram illustrating a configuration of a pixel circuit corresponding to m-th column and n-th row in the above embodiment.

Next, a description is given of a configuration and operation of the pixel circuit 52 in the display unit 50. FIG. 3 is a circuit diagram illustrating a configuration of the pixel circuit 52 corresponding to m-th column and n-th row. Note that the configuration of the pixel circuit 52 described herein is an example and other known configuration may be adopted. The pixel circuit 52 illustrated in FIG. 3 includes one organic EL element OLED, six transistors T1 to T6 (a drive transistor T1, a write control transistor T2, a power supply control transistor T3, a light emission control transistor T4, a threshold voltage compensation transistor T5, and an initialization transistor T6), and one capacitor C1. The transistors T1 to T6 are p-channel type transistors. The capacitor C1 is a capacitive element including two electrodes (a first electrode and a second electrode).

Note that one of a drain and a source which is higher in a potential than the other is called a drain in general, but, in the following description, one of them is defined to be a drain and the other is defined to be a source, and thus, a source potential may be higher than a drain potential in some cases.

The drive transistor T1 has a gate terminal which is connected with a source terminal of the threshold voltage compensation transistor T5, a drain terminal of the initialization transistor T6, and the second electrode of the capacitor C1, a drain terminal which is connected with a source terminal of the write control transistor T2 and a source terminal of the power supply control transistor T3, and a source terminal which is connected with a drain terminal of the light emission control transistor T4 and a drain terminal of the threshold voltage compensation transistor T5. The write control transistor T2 has a gate terminal connected with the scanning signal line G(n) of the n-th row, a drain terminal connected with the data line S(m) of the m-th column, and the source terminal which is connected with the drain terminal of the drive transistor T1 and the source terminal of the power supply control transistor T3. The power supply control transistor T3 has a gate terminal connected with the light emission control line EM(n) of the n-th row, a drain terminal which is connected with the high level power source line and the first electrode of the capacitor C1, and the source terminal which is connected with the drain terminal of the drive transistor T1 and the source terminal of the write control transistor T2.

The light emission control transistor T4 has a gate terminal connected with the light emission control line EM(n) of the n-th row, the drain terminal connected with the source terminal of the drive transistor T1 and the drain terminal of the threshold voltage compensation transistor T5, and a source terminal connected with an anode terminal of the organic EL element OLED. The threshold voltage compensation transistor T5 has a gate terminal connected with the scanning signal line G(n) of the n-th row, the drain terminal which is connected with the source terminal of the drive transistor T1 and the drain terminal of the light emission control transistor T4, and the source terminal which is connected with the gate terminal of the drive transistor T1, the drain terminal of the initialization transistor T6, and the second electrode of the capacitor C1. The initialization transistor T6 has a gate terminal connected with the scanning signal line G(n−1) of an (n−1)-th row, the drain terminal which is connected with the gate terminal of the drive transistor T1, the source terminal of the threshold voltage compensation transistor T5, and the second electrode of the capacitor C1, and a source terminal connected with the initialization power source line.

The capacitor C1 has the first electrode which is connected with the high level power source line and the drain terminal of the power supply control transistor T3, and the second electrode which is connected with the gate terminal of the drive transistor T1, the source terminal of the threshold voltage compensation transistor T5, and the drain terminal of the initialization transistor T6. The organic EL element OLED has the anode terminal connected with the source terminal of the light emission control transistor T4, and a cathode terminal connected with the low level power source line.

Figure 4:
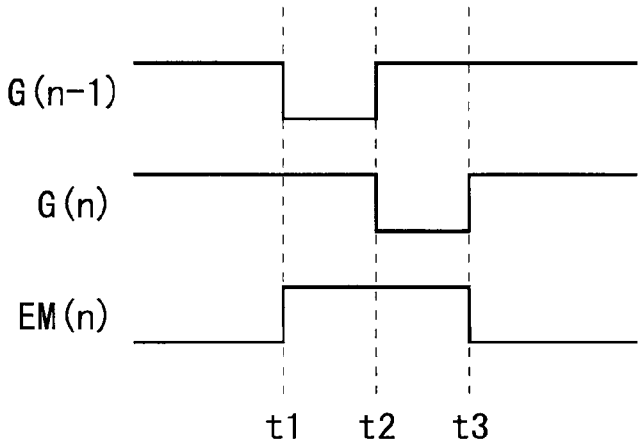
FIG. 4 is a timing chart for describing a driving method of the pixel circuit illustrated in FIG. 3 in the above embodiment.

FIG. 4 is a timing chart for describing a driving method of the pixel circuit 52 illustrated in FIG. 3. A time period to a time t1 and a time period from a time t3 correspond to a light emitting period of the organic EL element OLED in the pixel circuit 52. In the period to the time t1, the scanning signal G(n−1) and the scanning signal G(n) are at a high level, and the light emission control signal EM(n) is at a low level. At this time, the light emission control transistor T4 is in an ON state, so that the organic EL element OLED emits light according to a magnitude of a drive current.

When the time t1 is reached, the light emission control signal EM(n) is changed from the low level to the high level. This turns the light emission control transistor T4 to an OFF state. As a result, a supply of the drive current to the organic EL element OLED is stopped, so that the organic EL element OLED is switched off. At the time t1, the scanning signal G(n−1) also changes from the high level to the low level. This turns the initialization transistor T6 to an ON state. As a result, a gate voltage of the drive transistor T1 is initialized. In other words, the gate voltage of the drive transistor T1 becomes equal to the initialization voltage Vini.

At a time t2, the scanning signal G(n−1) changes from the low level to the high level. This turns the initialization transistor T6 to an OFF state. At the time t2, the scanning signal G(n) is also changed from the high level to the low level. This turns the write control transistor T2 and the threshold voltage compensation transistor T5 to an ON state. As a result, the data signal S(m) is given to the gate terminal of the drive transistor T1 via the write control transistor T2, the drive transistor T1, and the threshold voltage compensation transistor T5. With this operation, a gate voltage Vg of the drive transistor T1 has a magnitude expressed by Equation (1) below:

$$Vg = V\text{data} - Vth \tag{1}$$

where, Vdata represents a data voltage (voltage of the data signal S(m)), and Vth represents a threshold voltage (absolute value) of the drive transistor T1.

At the time t3, the scanning signal G(n) is changed from the low level to the high level. This turns the write control transistor T2 and the threshold voltage compensation transistor T5 to an OFF state. At the time t3, the light emission control signal EM(n) is also changed from the high level to the low level. This turns the power supply control transistor T3 and the light emission control transistor T4 to an ON state. With the above operation, a drive current I having a magnitude expressed by Equation (2) below is supplied to the organic EL element OLED so that the organic EL element OLED emits light according to the magnitude of the drive current I:

$$I = (\beta/2)\cdot(Vgs - Vth)^2 \tag{2}$$

where, β represents a constant, and Vgs represents a source-gate voltage of the drive transistor T1.

Here, the source-gate voltage Vgs of the drive transistor T1 is expressed by Equation (3) below.

$$\begin{aligned} Vgs &= ELVDD - Vg \\ &= ELVDD - Vdata + Vth \end{aligned} \tag{3}$$

When above Equation (3) is substituted in above Equation (2), Equation (4) below is obtained.

$$I = \beta/2\cdot(ELVDD - V\text{data})^2 \tag{4}$$

Above Equation (4) does not contain the term of the threshold voltage Vth. In other words, regardless of a magnitude of threshold voltage Vth of the drive transistor T1, the drive current I according to a magnitude of the data voltage is supplied to the organic EL element OLED. In this way, a variation in the threshold voltage Vth of the drive transistor T1 is compensated.

3. Deterioration Compensation Processing

In the organic EL display device according to the present embodiment, processing for compensating the deterioration of the organic EL elements OLEDs is performed by the deterioration compensation processing unit 100 in the display control circuit 10. This processing (deterioration compensation processing) is described below.

3.1 Overview

As described above, the deterioration degree of each organic EL element depends on a length of a lighting time period, a luminance at a lighting time or the like. Therefore, the deterioration degrees of the organic EL elements are different between pixels. Accordingly, in the present embodiment, data of the total time deterioration amount for each pixel (more strictly, for each sub pixel) is held to correct the gray scale values on the basis of the data, according to the deterioration degrees. At this time, the less the deterioration progresses, the smaller than original gray scale value the gray scale value is corrected. The data of the total time deterioration amount is updated every unit of time predetermined. At that time, the gray scale value, the brightness setting, and the temperature are taken into account to obtain the incremental deterioration amount per unit of time. The incremental deterioration amount represents a degree of progression of the deterioration at each time point (progression rate of the deterioration). As described above, the gray scale values are corrected on the basis of the data of the total time deterioration amount which is obtained for each pixel with the gray scale values, the brightness setting, and the temperature being taken into account. Correction of the gray scale values in this way compensates the deterioration of the organic EL elements and inhibits the image sticking from occurring. Note that the gray scale values are to be determined based on the input image signal DIN and the gray scale values are reflected to a displayed image by controlling values of the data voltages, whereas a brightness in the brightness setting is adjusted by a user and the brightness is reflected to the displayed image by, for example, controlling a width of the data voltage to be used or a time the supply of the drive current to the organic EL elements OLEDs is stopped, as described later.

3.2 Configuration of Deterioration Compensation Processing Unit

Figure 1:
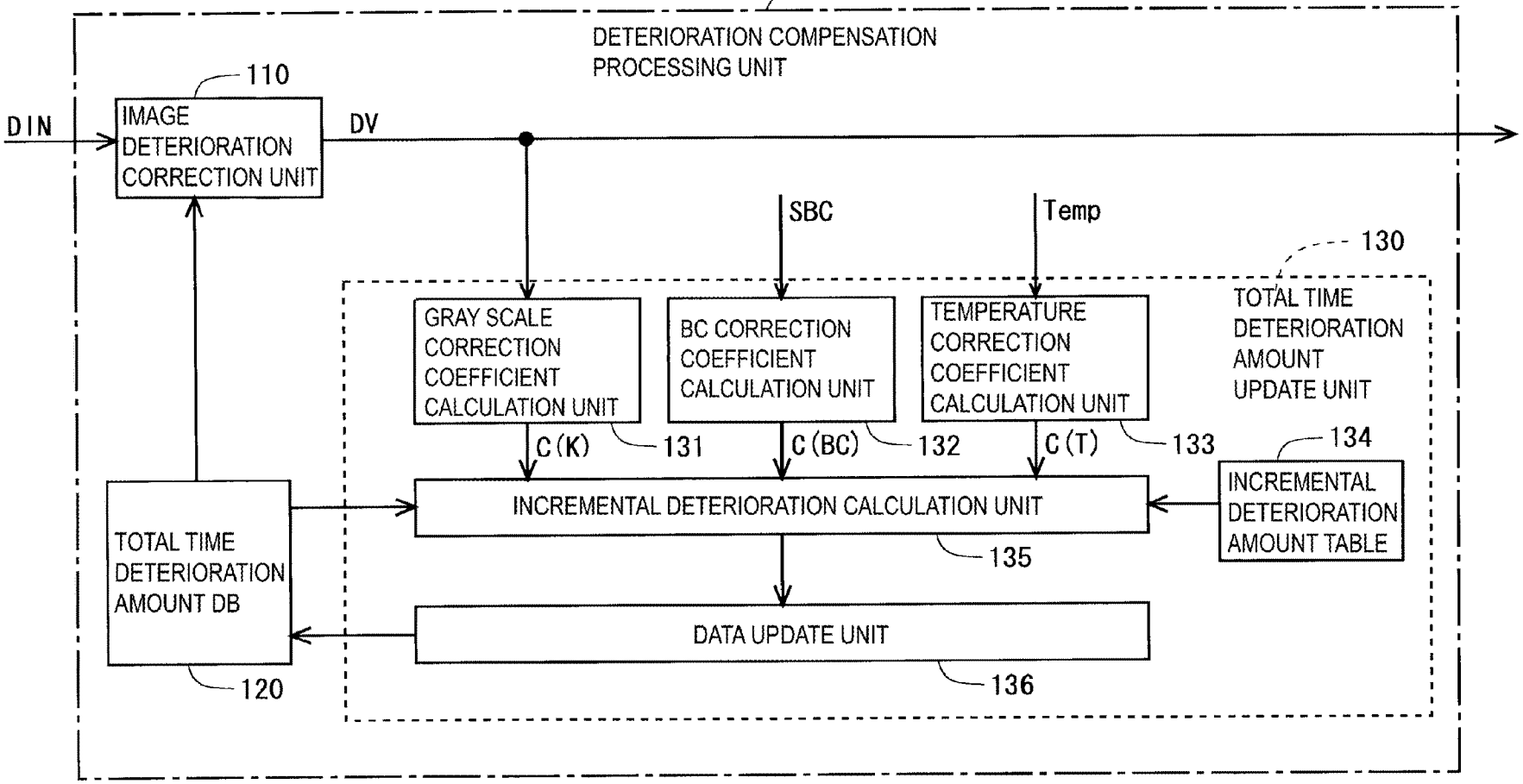
FIG. 1 is a block diagram illustrating a detailed functional configuration of a deterioration compensation processing unit in a display control circuit of an organic EL display device according to an embodiment of the disclosure.

FIG. 1 is a block diagram illustrating a detailed functional configuration of the deterioration compensation processing unit 100 in the display control circuit 10. The deterioration compensation processing unit 100 includes an image deterioration correction unit 110, a total time deterioration amount DB (database) 120, a total time deterioration amount update unit 130. In the present embodiment, the image deterioration correction unit 110 realizes a gray scale value correction unit, the total time deterioration amount DB 120 realizes a deterioration amount holding unit, and the total time deterioration amount update unit 130 realizes a deterioration amount update unit.

The total time deterioration amount DB 120 stores the data of the total time deterioration amounts for all pixels in the display unit 50 (that is, total time deterioration amount for each pixel). The image deterioration correction unit 110 corrects the gray scale values of the input image signal DIN (input gray scale values) according to the total time deterioration amounts, and outputs a digital video signal DV indicating the corrected gray scale values. At this time, the data of the total time deterioration amount is obtained for each pixel from the total time deterioration amount DB 120. In other words, the gray scale value is corrected for each pixel according to the total time deterioration amount. This correction of the gray scale values by the image deterioration correction unit 110 is performed for all frames. The total time deterioration amount update unit 130 updates the data of the total time deterioration amounts stored in the total time deterioration amount DB 120 (for each pixel) every unit of time predetermined (e.g., every two minutes). A configuration of the total time deterioration amount update unit 130 is described later in detail.

As described above, the gray scale value is corrected for each pixel on the basis of the data of the total time deterioration amount which is updated every unit of time when the digital video signal DV is generated from the input image signal DIN, to inhibit the image sticking from occurring even in a case where a difference occurs in the deterioration degrees of the organic EL elements OLEDs among pixels due to the use of the organic EL display device for a long time.

3.3 Correction of Gray Scale Values

Figure 5:
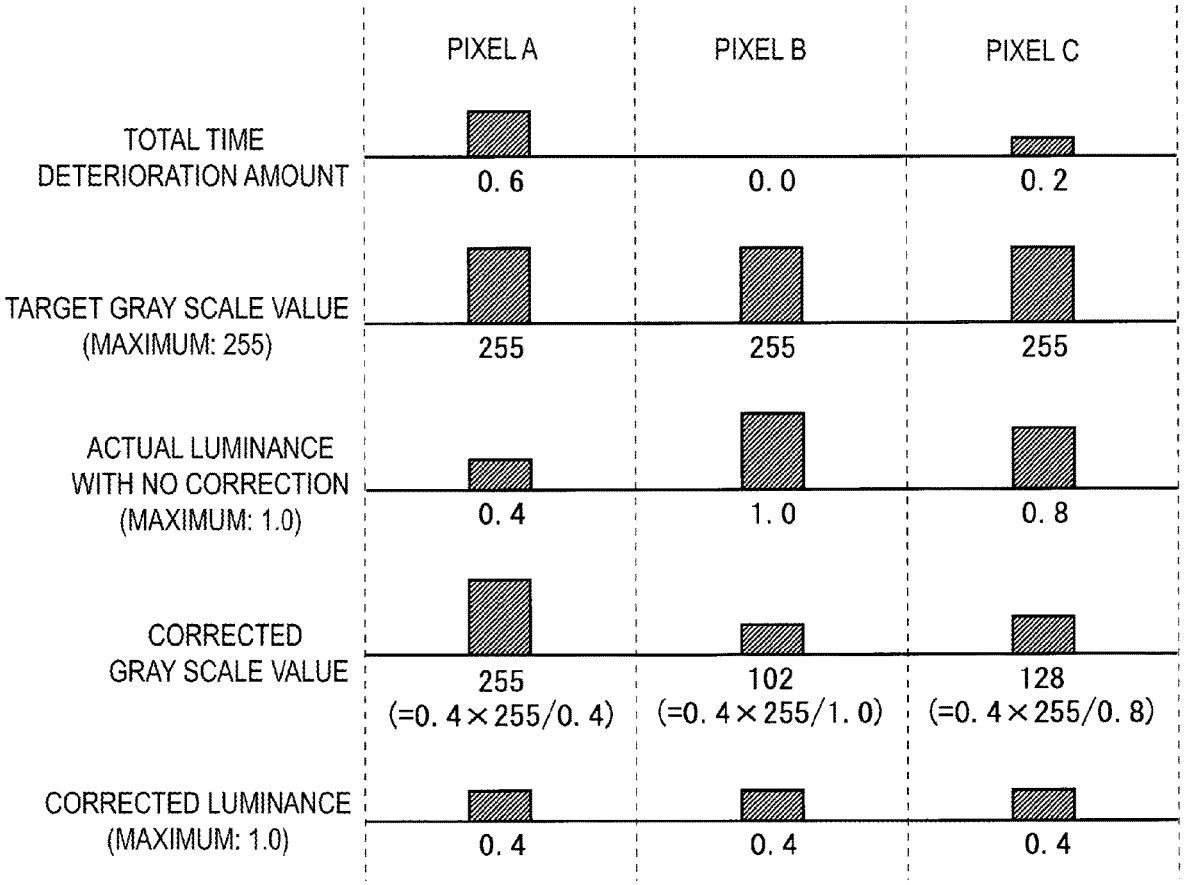
FIG. 5 is a diagram for describing how to compensate a gray scale value in the above embodiment.

With reference to FIG. 5, a description is given of how to correct the gray scale values. Here, a pixel having the largest total time deterioration amount in the all pixels is referred to as a "pixel A" (assume that a total time deterioration amount of the pixel A is 0.6), a pixel not deteriorated at all is referred to as a "pixel B", and a pixel having a total time deterioration amount of 0.2 is referred to as a "pixel C". Assume that the total time deterioration amount has a value from 0 to 1, where the total time deterioration amount with no deterioration is 0 and the total time deterioration amount with a deterioration to a degree substantially not to emit light is 1.

As illustrated in FIG. 5, assume that a target gray scale value (gray scale value of the input image signal DIN) is 255 (maximum gray scale value) in the all pixels. At that occasion, with the total time deterioration amount of each pixel being taken into account, in a case where the gray scale values are not corrected, a luminance of the pixel A is 0.4, a luminance of the pixel B is 1.0, and a luminance of the pixel C is 0.8 (note, a maximum value of luminance is assumed to be 1.0). In this way, even though the target gray scale values are the same, the difference in the total time deterioration amount causes a difference in the luminance among the pixels. Therefore, each of the gray scale values of pixels (referred to as "correction target pixel(s)" for convenience) other than the pixel A is corrected taking into account a total time deterioration amount of the correction target pixel and the total time deterioration amount of the pixel A. To be more specific, a corrected gray scale value V2 of each correction target pixel is calculated using Equation (5) below:

$$V2=V1\times((1-D\max)/(1-Dt)) \quad (5)$$

where, V1 represents a target gray scale value of the correction target pixel, Dmax represents the total time deterioration amount of the pixel A (pixel having the largest total time deterioration amount), and Dt represents the total time deterioration amount of the correction target pixel.

As described above, each gray scale value of the correction target pixel is corrected into a value smaller than the original gray scale value according to the deterioration degree of the organic EL element OLED included in the correction target pixel. To be more specific, the image deterioration correction unit 110 corrects the gray scale values on the basis of the data of the total time deterioration amounts held in the total time deterioration amount DB 120 at the time of generating the digital video signal DV from the input image signal DIN, in such a way that the smaller relatively the deterioration amount of an organic EL element OLED, the smaller the gray scale value of the digital video signal DV corresponding to the pixel circuit 52 including the organic EL element OLED as compared to the gray scale value of the input image signal DIN.

According to above Equation (5), a corrected gray scale value of the pixel A is 255, a corrected gray scale value of the pixel B is 102, and a corrected gray scale value of the pixel C is 128. As a result, taking into account the total time deterioration amount of each pixel, the luminance of the all pixels is 0.4. With this correction, in a case where the target gray scale values of multiple pixels are the same, the organic EL elements OLEDs in those multiple pixels light at the same luminance. That is, the image sticking is inhibited from occurring.

In the display device, gamma characteristics of a panel are usually taken into account. Therefore, the corrected gray scale value V2 of each correction target pixel is preferably calculated by using Equation (6) below instead of above Equation (5):

$$V2=((1-D\max)\times L1\times(V\max^{\gamma})/(1-Dt))^{1/\gamma} \quad (6)$$

where, γ represents a gamma value of the organic EL panel 5, Vmax represents a maximum gray scale value (that is 255, here), and L1 represents a luminance corresponding to the target gray scale value (luminance at which displaying is desirably performed) which is obtained by $(V1/V\max)^{\gamma}$.

3.4 Update of Total Time Deterioration Amount

Next, a description is given of update of (the data of) the total time deterioration amounts stored in the total time deterioration amount DB (database) 120 in detail. In general, the organic EL element deteriorates as time elapses, and a deterioration degree depends on the gray scale value, the brightness setting, the temperature, and the like. The gray scale values, the brightness setting, and the temperature may change during the use of the device. Accordingly, in the present embodiment, the gray scale values, the brightness setting, and the temperature are taken into account to obtain the incremental deterioration amount every unit of time as described above, and the incremental deterioration amount is added to the total time deterioration amount immediately before the update to obtain a current total time deterioration amount.

Figure 6:
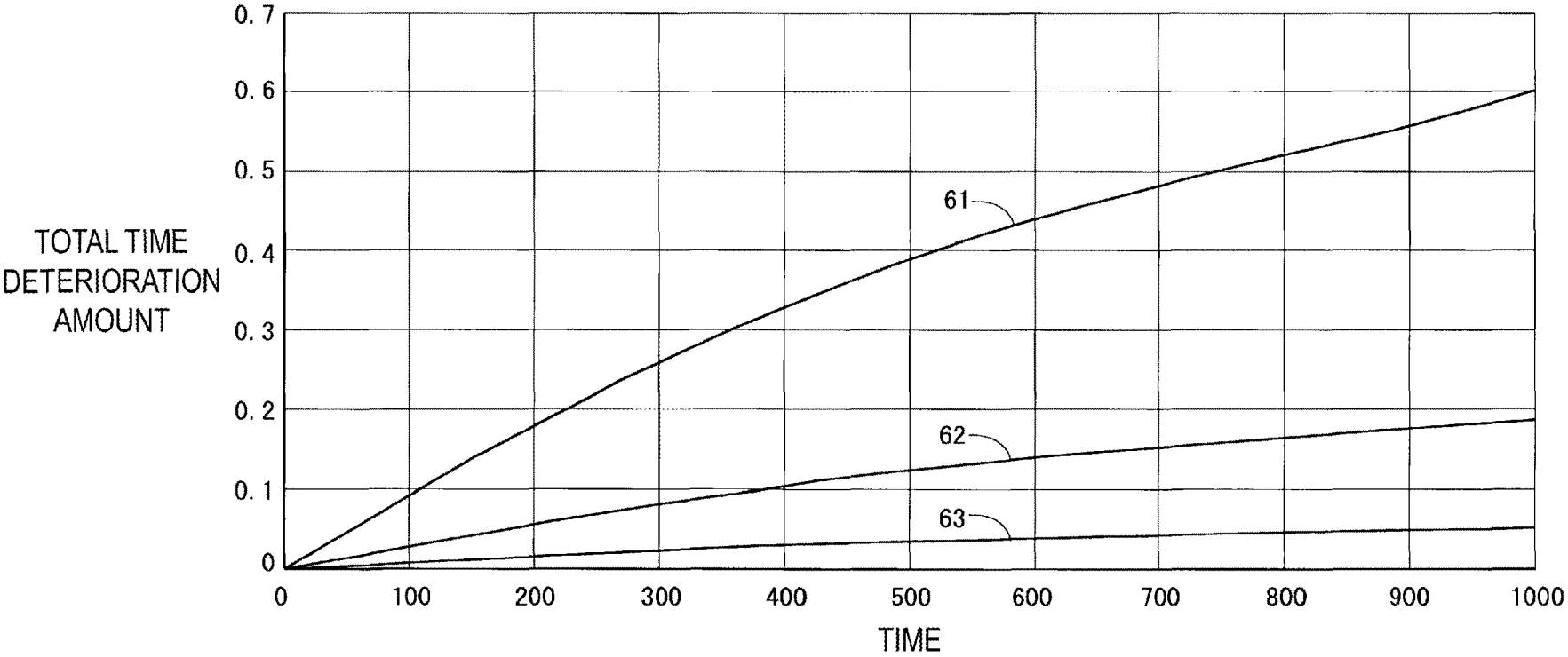
FIG. 6 is a graph for describing a difference in a deterioration degree depending on a gray scale value.
Figure 7:
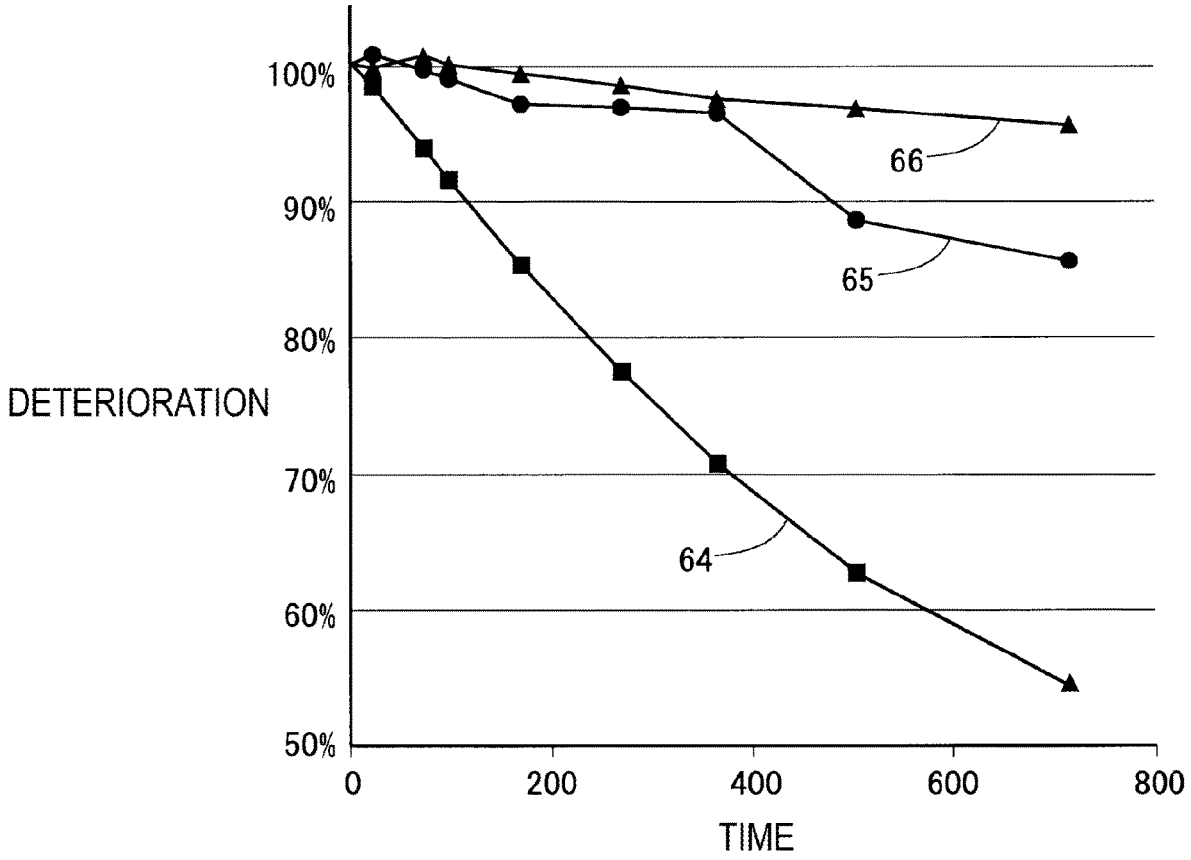
FIG. 7 is a graph for describing a difference in a deterioration degree depending on a gray scale value.

FIG. 6 is a graph for describing the difference in the deterioration degree depending on the gray scale value. FIG. 6 illustrates the changes in the total time deterioration amounts for three gray scale values when the "brightness setting is maximum" and the "temperature is 25° C." Curved lines designated by reference signs 61, 62, and 63 represent the changes in the total time deterioration amounts when the gray scale values are 255, 174, and 90, respectively. As seen from FIG. 6, it can be understood that the larger the gray scale value (that is, the higher the luminance), the slower a speed of the deterioration. In addition, as seen from FIG. 6, it can be understood that the progression of the deterioration is moderated as time elapses. FIG. 7 also illustrates the changes in the deterioration for three gray scale values described above. FIG. 7 illustrates the changes in the deterioration when the gray scale values are 255, 174, and 90 by polygonal lines designated by reference signs 64, 65, and 66, respectively. In FIG. 7, a state with no deterioration is assumed to be 100%.

Figure 8:
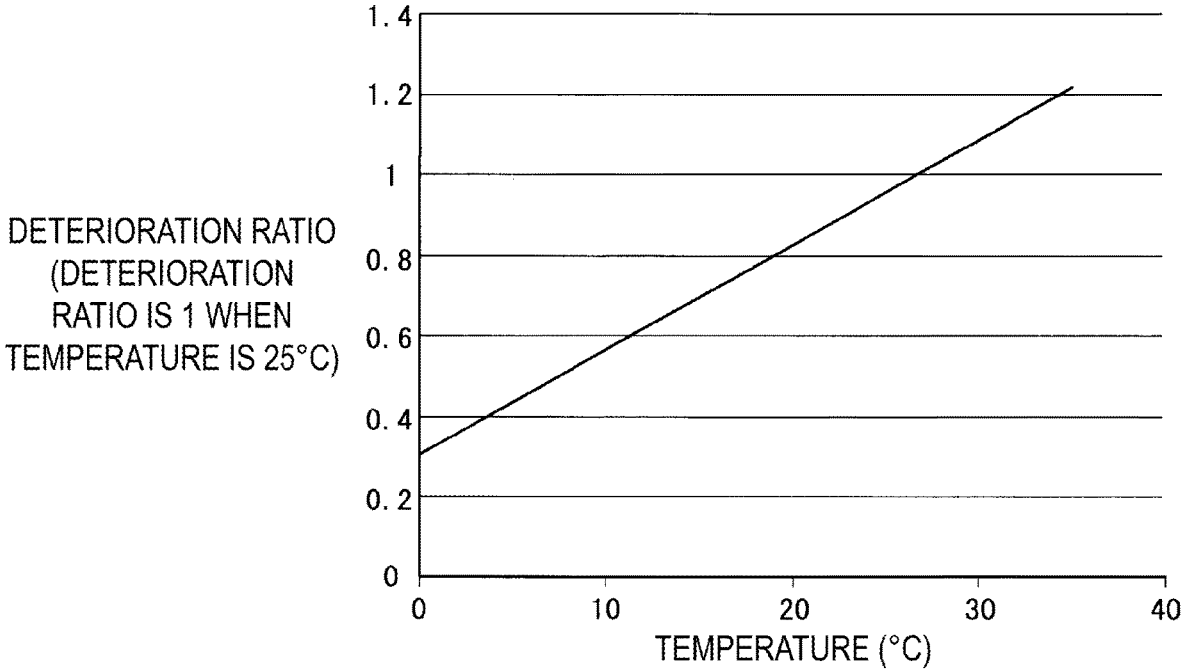
FIG. 8 is a graph for describing a difference in a deterioration degree depending on a temperature.

FIG. 8 is a graph for describing the difference in the deterioration degree depending on the temperature. Assume that a deterioration ratio is 1 when a temperature is 25° C. As seen from FIG. 8, it can be understood that the higher the temperature, the larger the deterioration degree. In addition, as seen from FIG. 8, it can be understood that a relationship between the temperature and the deterioration ratio is a linear relationship.

Figure 9:
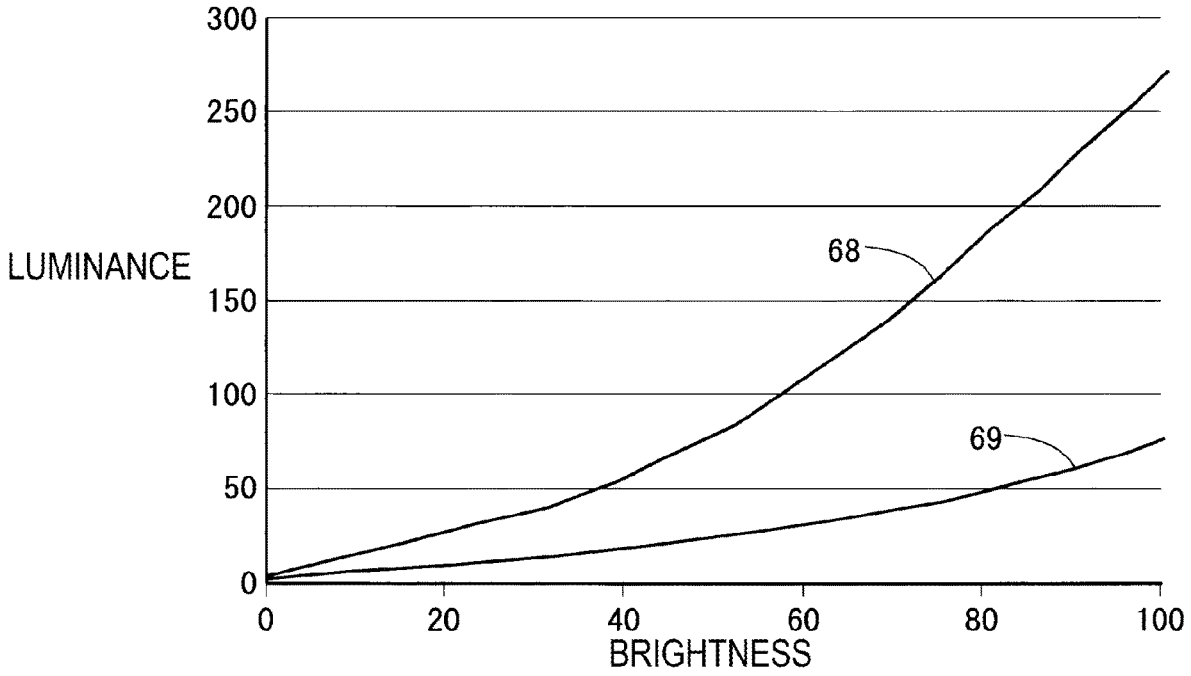
FIG. 9 is a graph for describing a relationship between a brightness setting and a luminance.

FIG. 9 is a graph for describing a relationship between the brightness setting and the luminance. Note that the brightness setting is a function provided to the organic EL display device so that the user can adjust the brightness of an entire screen (a detailed specification of the function differs according to models). Here, assume that the brightness is maximum when the set value is 100, and the brightness is minimum when the set value is 0. FIG. 9 illustrates the relationship between the brightness setting and the luminance when the gray scale values are 255 and 128 by curved lines designated by reference signs 68 and 69, respectively. In an example illustrated in FIG. 9, the relationship between the brightness setting and the luminance is a non-linear relationship. It can be understood that the larger the set value in the brightness setting, the larger the deterioration degree because the higher the luminance, the larger the deterioration degree.

Figure 10:
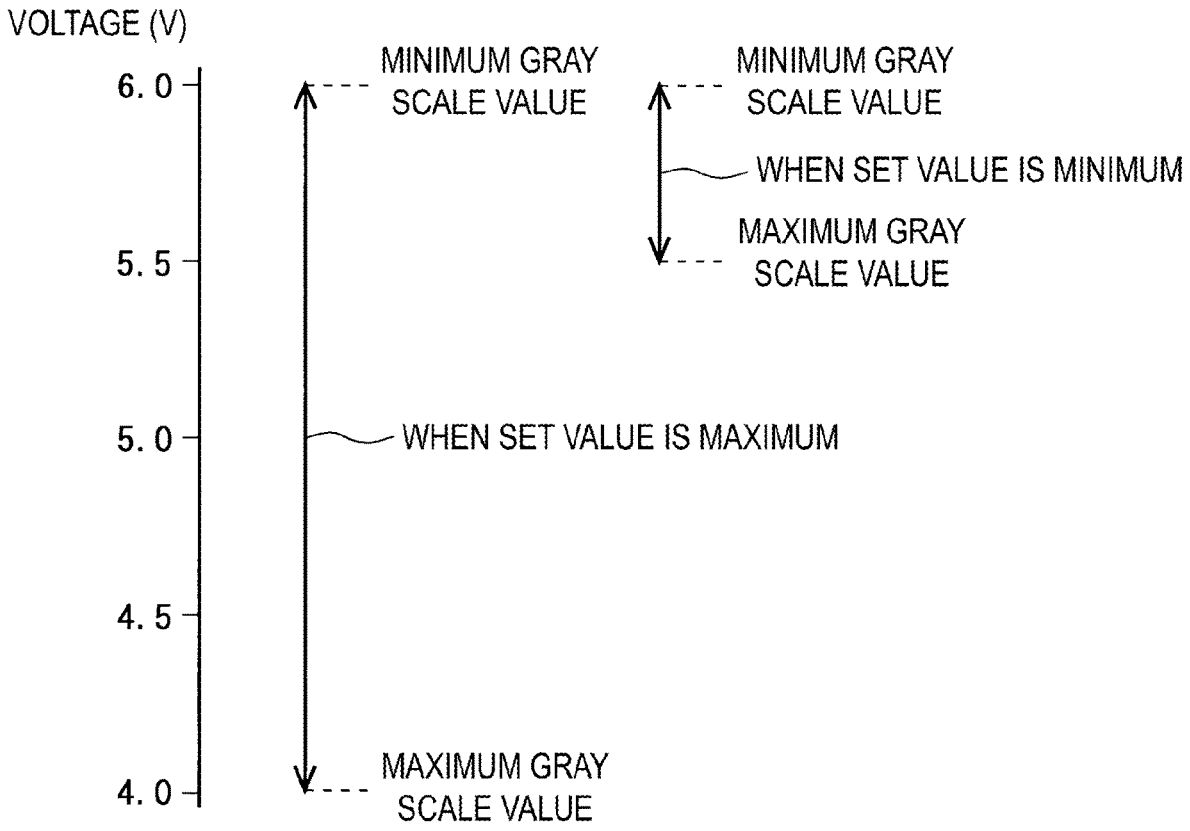
FIG. 10 a diagram for describing control of a brightness across an entire screen on the basis of the brightness setting.

In the brightness setting described above, for example, the width of the data voltage to be used is changed by the set value to control the brightness of the entire screen. In an example illustrated in FIG. 10, a voltage in a range from 4.0 V to 6.0 V is used as the data voltage when the set value is maximum, whereas a voltage in a range from 5.5 V to 6.0 V is used as the data voltage when the set value is minimum. For example, the light emission control signals EM(1) to EM(j) may be used to adequately control the ON/OFF state of light emission control transistors T4 (see FIG. 3) to control the supply of the drive current to organic EL elements OLEDs, such that the brightness across the entire screen is controlled. In this case, the control may be such that the smaller that set value, the longer the time the supply of the drive current to each organic EL element OLED is stopped. Further, the control of the width of the data voltage to be used and the control of the time the supply of the drive current to each organic EL element OLED is stopped may be combined to control the brightness of the entire screen.

In the present embodiment, the above points concerning the gray scale values, brightness setting, and temperature are taken into account to obtain the incremental deterioration amounts of the organic EL elements OLEDs in unit of time. Specifically, coefficients corresponding to each gray scale value, the brightness setting, and the temperature are defined with the above points being taken into account, and these coefficients are used to obtain the incremental deterioration amount per unit of time. Then, the incremental deterioration amount obtained every unit of time is accumulated to obtain the total time deterioration amount which is to be used to correct the gray scale value at each time point. Note that a coefficient determined based on the gray scale value is referred to as a "gray scale correction coefficient", a coefficient determined based on the brightness setting is referred to as a "BC correction coefficient", and a coefficient determined based on the temperature is referred to as a "temperature correction coefficient". A description is given below of the gray scale correction coefficient, the BC correction coefficient, and the temperature correction coefficient.

Figure 11:
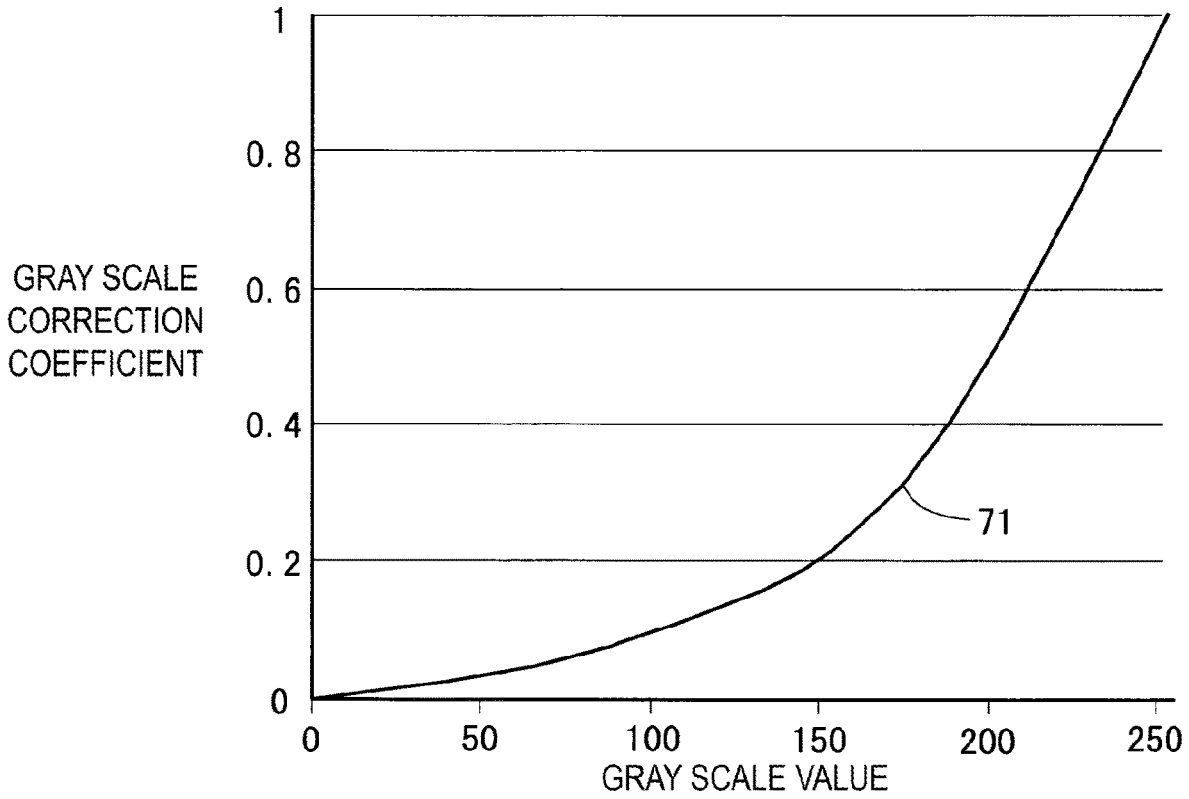
FIG. 11 is a graph for describing a relationship between a gray scale value and a value of a gray scale correction coefficient in the above embodiment.

FIG. 11 is a graph for describing a relationship between the gray scale value and a value of the gray scale correction coefficient. The value of the gray scale correction coefficient is 0 when gray scale value is 0, and the value of the gray scale correction coefficient is 1 when the gray scale value is 255. The relationship between the gray scale value and the value of the gray scale correction coefficient is represented by, for example, a gamma curve convex downward like a curved line as illustrated in FIG. 11, designated by a reference sign 71, where the larger the gray scale value, the larger the value of the gray scale correction coefficient. Such a relationship between the gray scale value and the value of the gray scale correction coefficient is held in a form of a look-up table, for example.

Figure 12:
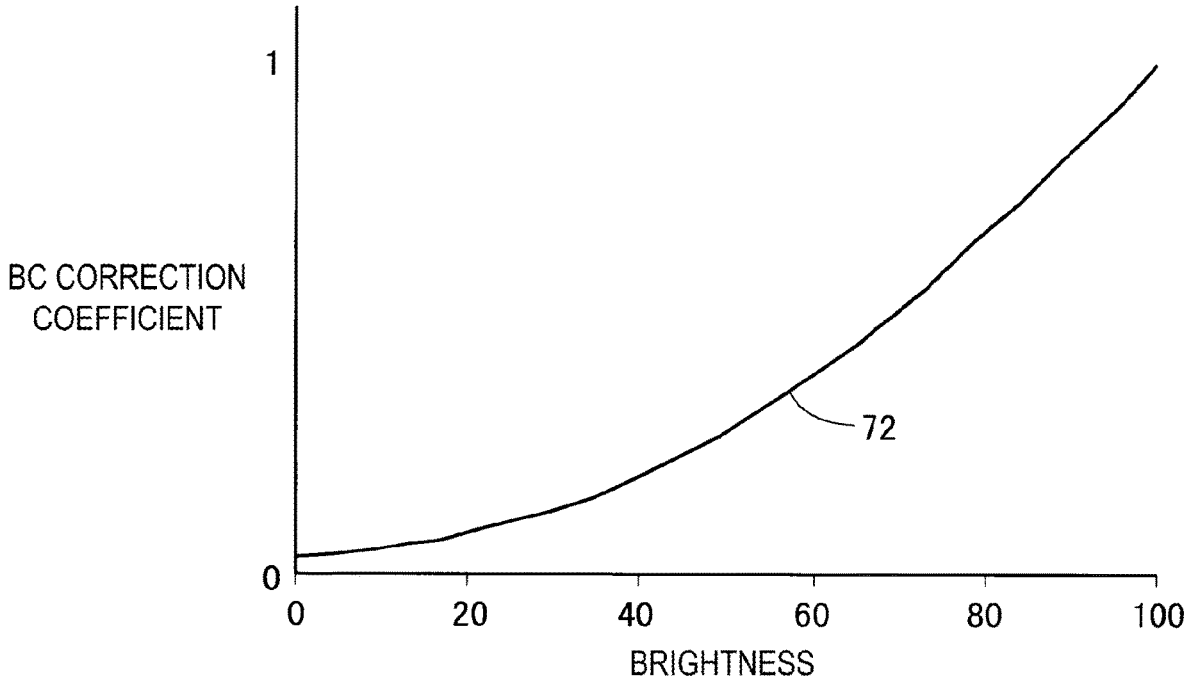
FIG. 12 is a graph for describing a relationship between a set value by the brightness setting and a value of a BC correction coefficient in the above embodiment.

FIG. 12 is a graph for describing a relationship between the set value by the brightness setting and a value of the BC correction coefficient. The value of the BC correction coefficient is 0 when the set value is 0, and the value of the BC correction coefficient is 1 when the set value is 100. The relationship between the set value by the brightness setting and the value of the BC correction coefficient depends on a specification of the brightness setting in each organic EL display device, but may be represented by a curved line as illustrated in FIG. 12, designated by a reference sign 72, for example. As understood from FIG. 12, the larger the set value by the brightness setting, the larger the value of the BC correction coefficient.

Figure 13:
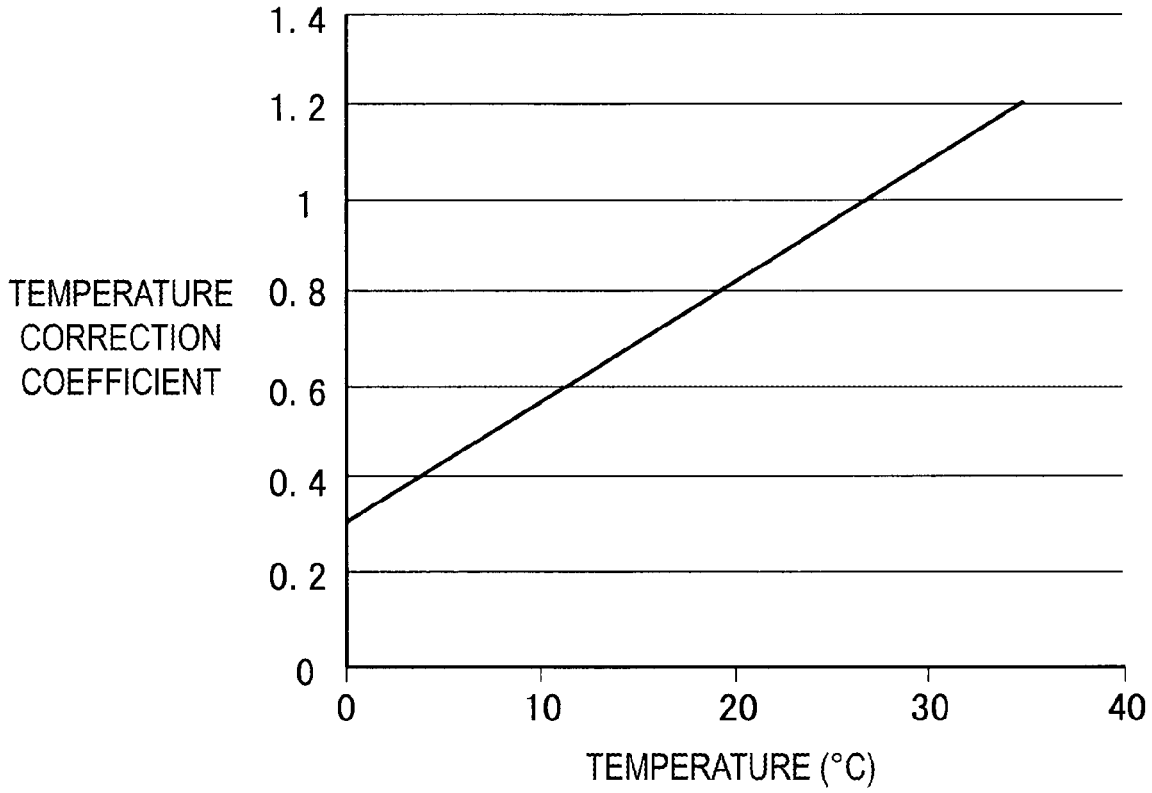
FIG. 13 is a graph for describing a relationship between a temperature and a value of a temperature correction coefficient in the above embodiment.

FIG. 13 is a graph for describing a relationship between the temperature and a value of the temperature correction coefficient. As illustrated in FIG. 13, the value of the temperature correction coefficient is 1, for example, when the temperature is 25° C., and the higher the temperature, the larger the value of the temperature correction coefficient.

In the present embodiment, according to the relationships described above, respective values of three coefficients (gray scale correction coefficient, BC correction coefficient, and temperature correction coefficient) are defined on the basis of the gray scale value, the set value by the brightness setting, and the temperature. A value obtained by multiplying these three coefficient values is used as a deterioration coefficient, which deterioration coefficient is used in calculating the incremental deterioration amount as described later.

Figure 14:
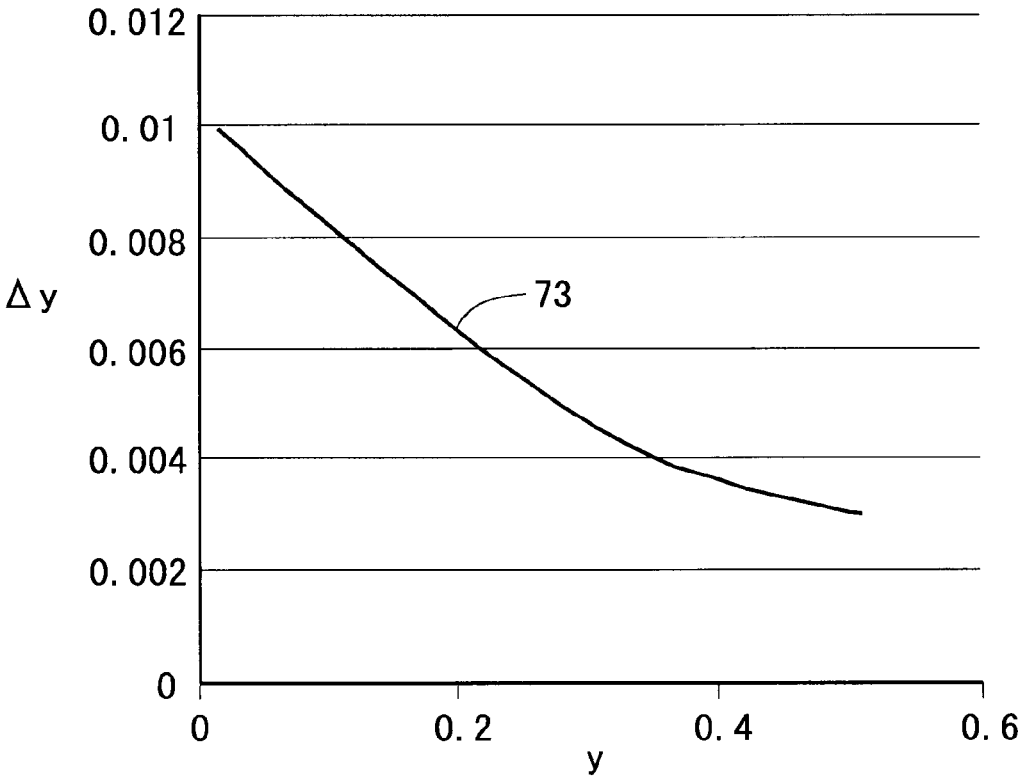
FIG. 14 is a graph illustrating a relationship between a total time deterioration amount and an incremental deterioration amount per unit of time in the above embodiment.

As understood from FIG. 6, as for the organic EL element, the larger the total time deterioration amount, the smaller the incremental deterioration amount per unit of time. Therefore, a relationship between a total time deterioration amount y and an incremental deterioration amount Δy per unit of time is represented by a curved line as illustrated in FIG. 14, designated by a reference sign 73. In the present embodiment, an incremental deterioration amount table 134 is provided to the total time deterioration amount update unit 130 (see FIG. 1), the incremental deterioration amount table 134 being a look-up table holding the relationship between the total time deterioration amount y and the incremental deterioration amount Δy per unit of time (relationship as illustrated in FIG. 14). When the total time deterioration amount is updated, the incremental deterioration amount table 134 is referred to, to obtain the incremental deterioration amount. The curved line in FIG. 14 designated by the reference sign 73 can be expressed by "Δy=g(y)" where g is a function with y as an argument. In other words, the incremental deterioration amount table 134 is a look-up table holding a relationship expressed by "Δy=g(y)". Note that this incremental deterioration amount table 134 realizes an incremental deterioration amount calculation look-up table. The incremental deterioration amount table 134 is only necessary to hold some of possible values of a value of the total time deterioration amount y. A value of the incremental deterioration amount Δy corresponding to the value of the total time deterioration amount y not held in the incremental deterioration amount table 134 may be obtained through linear interpolation using values held in the incremental deterioration amount table 134. Regarding the relationship between the total time deterioration amount y and the incremental deterioration amount Δy per unit of time, FIG. 15 illustrates an example of specific values.

Figure 16:
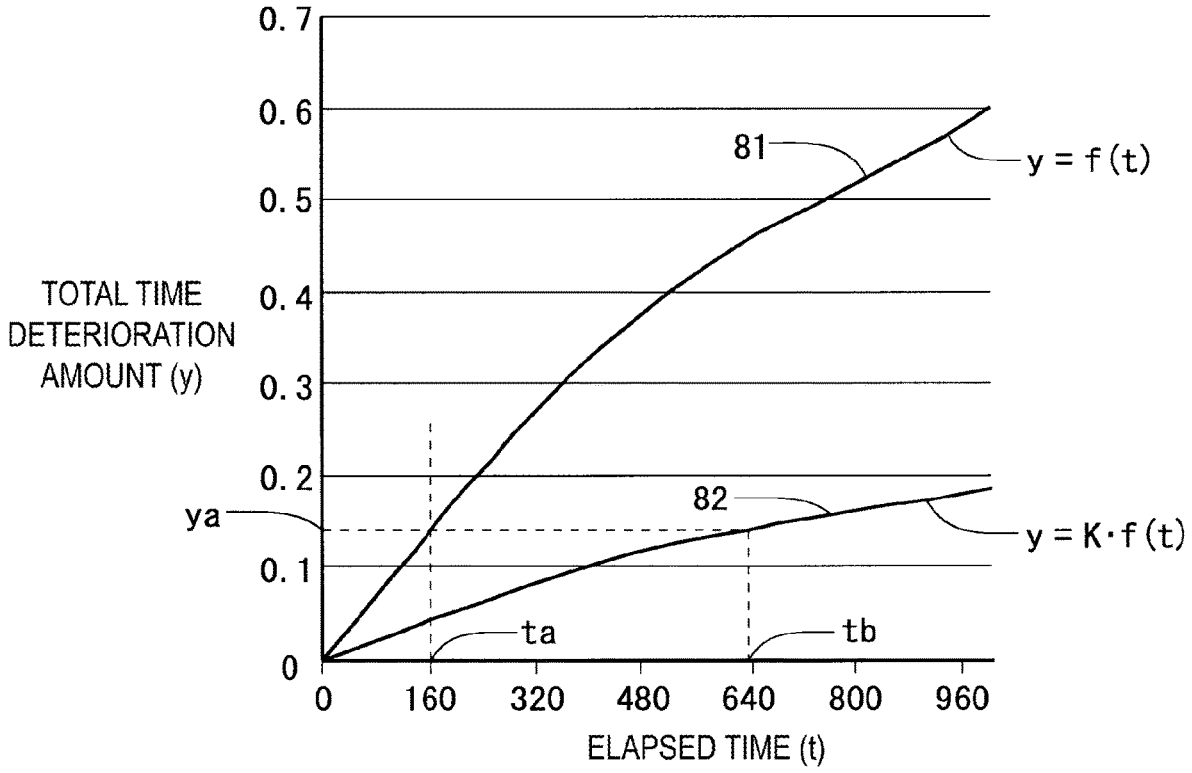
FIG. 16 is a graph for describing how to obtain an incremental deterioration amount per unit of time in the above embodiment.
Figure 17:
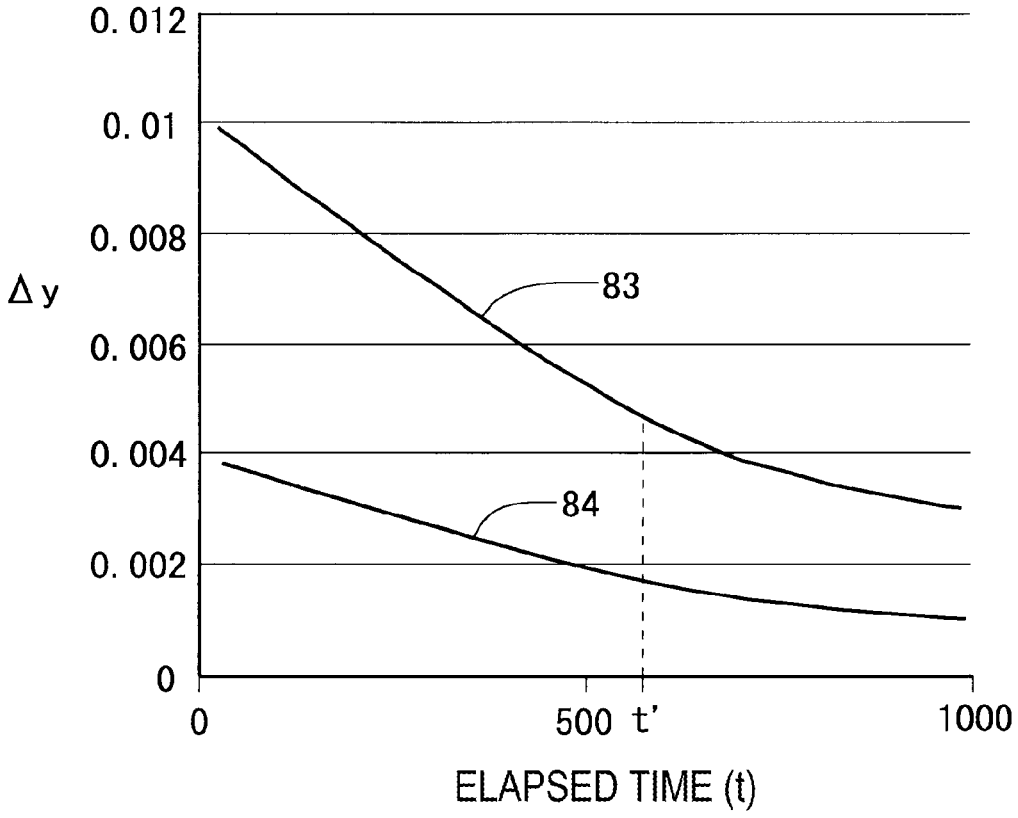
FIG. 17 is a graph for describing how to obtain an incremental deterioration amount per unit of time in the above embodiment.

Here, with reference to FIG. 16 and FIG. 17, a description is given of how to obtain an incremental deterioration amount Δy' in a case where a value of the deterioration coefficient described above is K (K is a variable). Changes of the total time deterioration amount y of the organic EL element is represented by a curved line "y=f(t)" in FIG. 16 designated by a reference sign 81, for example. At this time, a curved line "y=K·f(t)" is represented by a curved line in FIG. 16 designated by a reference sign 82, for example. Here, assume that the total time deterioration amount y of a pixel to be processed is ya (where, the value of the deterioration coefficient is K). Assuming that a value of t satisfying "y=ya" for the curved line "y=f(t)" is ta, and a value of t satisfying "y=ya" for the curved line "y=K·f(t)" is tb, Equation (7) and Equation (8) below holds.

$$ya=f(ta) \tag{7}$$

$$ya=K\cdot f(tb) \tag{8}$$

From above Equation (7) and above Equation (8), Equation (9) below holds.

$$f(ta)=K\cdot f(tb) \tag{9}$$

From above Equation (9), Equation (10) below holds:

$$tb=f^{-1}((1/K)\cdot f(ta)) \tag{10}$$

where, $f^{-1}$ is an inverse function of f.

Assuming that a function representing the incremental deterioration amount per unit of time in the curved line "y=f(t)" is d(t), an incremental amount in the curved line "y=f(t)" at a time tb is expressed by d(tb). At that occasion, a desired incremental deterioration amount Δy' is expressed by K·d(tb). This term K·d(tb) can be transformed into Equation (11) below according to above Equation (10) and above Equation (7).

$$\begin{aligned} K\cdot d(tb) &= K\cdot d(f^{-1}((1/K)\cdot f(ta))) \\ &= K\cdot d(f^{-1}((1/K)\cdot ya)) \end{aligned} \tag{11}$$

The incremental deterioration amount per unit of time in the curved line "y=f(t)" which depends on the total time deterioration amount y can be expressed by "d(t)=g(y)". An equation "$t=f^{-1}(y)$" holds by the equation "y=f(t)", and thus, Equation (12) below holds.

$$\begin{aligned} d(t) &= d(f^{-1}(y)) \\ &= g(y) \end{aligned} \tag{12}$$

Further, from above Equation (11) and above Equation (12), Equation (13) below holds.

$$\begin{aligned} K\cdot d(tb) &= K\cdot d(f^{-1}((1/K)\cdot ya)) \\ &= K\cdot g((1/K)\cdot ya) \end{aligned} \tag{13}$$

Therefore, in a case where the total time deterioration amount of the organic EL element OLED included in the pixel to be processed is y, and a value of the deterioration correction coefficient is K, the incremental deterioration amount Δy' per unit of time of the organic EL element OLED is expressed by Equation (14) below.

$$\Delta y' = K \cdot g((1/K) \cdot y) \quad (14)$$

The incremental deterioration amount table 134 is a look-up table holding the relationship expressed by "Δy=g (y)", as described above. From above Equation (14), a desired incremental deterioration amount Δy' can be obtained by multiplying a value obtained by passing the argument of "(1/K)·y" to the above function g by K. In the present embodiment, the incremental deterioration amount Δy' obtained in this way is added to the total time deterioration amount y held in the total time deterioration amount DB 120 to obtain an updated total time deterioration amount (that is, the current total time deterioration amount) y'. To be more specific, the updated total time deterioration amount y' is calculated using Equation (15) below.

$$y' = y + \Delta y' \quad (15)$$

On the basis of the above points, a description is given of a configuration and operation of the total time deterioration amount update unit 130 (see FIG. 1). The total time deterioration amount update unit 130 includes a gray scale correction coefficient calculation unit 131, a BC correction coefficient calculation unit 132, a temperature correction coefficient calculation unit 133, the incremental deterioration amount table 134, an incremental deterioration calculation unit 135, and a data update unit 136, as illustrated in FIG. 1.

The gray scale correction coefficient calculation unit 131 obtains, for the data of each pixel, a gray scale correction coefficient C(K) on the basis of the gray scale value of the digital video signal DV (that is, the gray scale value corrected by the image deterioration correction unit 110) (see FIG. 11). The BC correction coefficient calculation unit 132 obtains a BC correction coefficient C(BC) on the basis of a set value SBC in the brightness setting in the organic EL display device (see FIG. 12). The temperature correction coefficient calculation unit 133 obtains a temperature correction coefficient C(T) on the basis of a temperature Temp detected by a temperature sensor, for example (see FIG. 13).

The incremental deterioration amount table 134 holds the relationship between the total time deterioration amount y and the incremental deterioration amount Δy per unit of time as described above (see FIG. 14). The incremental deterioration calculation unit 135 obtains the deterioration coefficient for each pixel by multiplying the gray scale correction coefficient C(K), the BC correction coefficient C(BC), and the temperature correction coefficient C(T) together. Then, the incremental deterioration calculation unit 135 refers to the incremental deterioration amount table 134 for each pixel on the basis of the total time deterioration amount held in the total time deterioration amount DB 120 and deterioration coefficient to obtain the current deterioration amount (that is, the updated total time deterioration amount). The data update unit 136 updates the data of the total time deterioration amount for each pixel held in the total time deterioration amount DB 120, by using the value obtained by the incremental deterioration calculation unit 135.

Figure 18:
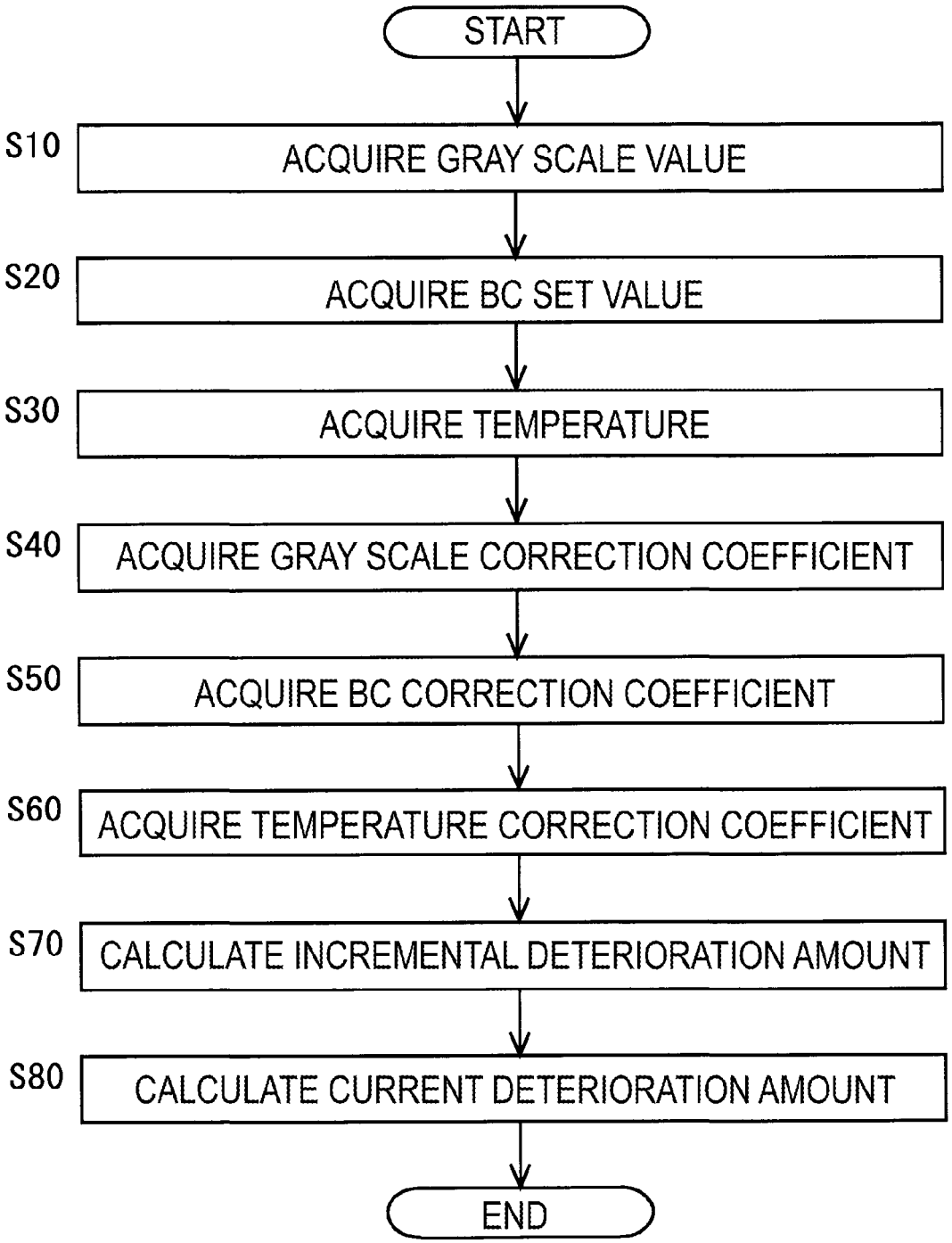
FIG. 18 is a flowchart illustrating a procedure for obtaining a total time deterioration amount of the organic EL element in the above embodiment.

Here, a procedure for obtaining the total time deterioration amount of each organic EL element OLED is summarized. FIG. 18 is a flowchart illustrating the procedure for obtaining the total time deterioration amount of the organic EL element. This processing is performed by the total time deterioration amount update unit 130. First, each gray scale value is acquired on the basis of the digital video signal DV output from the image deterioration correction unit 110 (step S10). Next, the set value SBC in the brightness setting is acquired (step S20). Note that the set value SBC in the brightness setting is held in a register or the like, for example. Next, the current temperature is acquired on the basis of an output from the temperature sensor, for example (step S30). After that, each gray scale correction coefficient C(K) is acquired on the basis of the corresponding gray scale value acquired at step S10 (step S40). Next, the BC correction coefficient C(BC) is acquire on the basis of the set value SBC acquired at step S20 (step S50). Next, the temperature correction coefficient C(T) is acquired on the basis of the temperature acquired at step S30 (step S60). After that, each incremental deterioration amount is calculated by referring to the incremental deterioration amount table 134 on the basis of the deterioration coefficient obtained by multiplying corresponding gray scale correction coefficient C(K), the BC correction coefficient C(BC), and the temperature correction coefficient C(T) together and the total time deterioration amount held in the total time deterioration amount DB 120 (step S70). Then, the current deterioration amount (that is, the updated total time deterioration amount) is calculated by adding the incremental deterioration amount to the total time deterioration amount (step S80).

In the present embodiment, a parameter data acquisition step is realized by steps S10 to S30, an incremental deterioration amount calculation step is realized by step S70, and a deterioration amount calculation step is realized by step S80. Moreover, a gray scale value acquisition step is realized by step S10, a brightness set value acquisition step is realized by step S20, and a temperature acquisition step is realized by step S30.

4. Effect

According to the present embodiment, the organic EL display device is provided with the total time deterioration amount DB 120 holding the data of the total time deterioration amount for each pixel. On the basis of the data of the total time deterioration amount held in the total time deterioration amount DB 120, each gray scale value is corrected in such a way that the smaller relatively the total time deterioration amount of the organic EL element OLED, the smaller the gray scale value of the digital video signal DV corresponding to the pixel circuit 52 including the organic EL element OLED as compared to the gray scale value of the input image signal DIN. The data of the total time deterioration amount held in the total time deterioration amount DB 120 is updated every unit of time prescribed. At that time, the gray scale values, the brightness setting, and the temperature are taken into account to obtain the incremental deterioration amounts per unit of time. The deterioration degree of each organic EL element OLED depends on the gray scale value, the brightness setting, and the temperature, which are taken into account to obtain the incremental deterioration amount, and the incremental deterioration amount is used to calculate the total time deterioration amount to allow the total time deterioration amount of the organic EL element OLED to be accurately obtained at each time point. As a result, each gray scale value is corrected on the basis of the data of the total time deterioration amount accurately obtained, to thereby improve correction accuracy of the gray scale value. Therefore, the image sticking is effectively inhibited from occurring. As described above, according to the present embodiment, the organic EL display device is achieved which can effectively inhibit the image sticking caused by the deterioration of the organic EL elements OLEDs from occurring.

5. Modification 5.1 Calculation of Value of Deterioration Coefficient

In the above embodiment, the value of the deterioration coefficient K used in calculating the incremental deterioration amount is obtained by multiplying the gray scale correction coefficient C(K), the BC correction coefficient C(BC), and the temperature correction coefficient C(T) together. In other words, the value of the deterioration coefficient K is obtained using Equation (16) below.

$$K=C(K)\times C(BC)\times C(T) \quad (16)$$

However, the disclosure is not limited to the above, and the value of the deterioration coefficient K may be obtained using Equation (17) or Equation (18) below.

$$K=C(K)\times C(BC) \quad (17)$$

$$K=C(K)\times C(T) \quad (18)$$

According to the above description, the current total time deterioration amount can be obtained by obtaining the incremental deterioration amount of the organic EL element OLED included in each pixel circuit 52 on the basis of the deterioration coefficient calculated using any of above Equations (16) to (18) and the total time deterioration amount held in the total time deterioration amount DB 120, and adding the obtained incremental deterioration amount to the total time deterioration amount held in the total time deterioration amount DB 120. In other words, the current total time deterioration amount can be obtained by taking into account the gray scale value of the digital video signal DV corresponding to each pixel circuit 52 and at least one of the set value in the brightness setting and the temperature to obtain the incremental deterioration amount of the organic EL element OLED included in each pixel circuit 52, and adding the obtained incremental deterioration amount to the total time deterioration amount held in the total time deterioration amount DB 120.

In a configuration where the gray scale values of the digital video signal DV are determined on the basis of the gray scale values of the input image signal DIN and the set value in the brightness setting, there may be used a coefficient obtained by integrating the gray scale correction coefficient C(K) and the BC correction coefficient C(BC) into one coefficient (hereinafter, which is referred to as a "gray scale BC correction coefficient", and designated by a reference sign C(KBC)). In this case, Equation (19) or Equation (20) below can be used to obtain the deterioration coefficient K.

$$K=C(KBC)\times C(T) \quad (19)$$

$$K=C(KBC) \quad (20)$$

Further, in calculating the value of the deterioration coefficient, other coefficient than three coefficients described above (gray scale correction coefficient, BC correction coefficient, and temperature correction coefficient) may be used. In this regard, according to a certain study, it has been found that a lifetime of an organic EL element heavily depends on an element fabrication time (time from production process starting to sealing), and thus, the shorter the fabrication time, the more durability of the organic EL element is improved. Therefore, a coefficient determined according to a length of the fabrication time of the organic EL element (hereinafter, referred to as an "element fabrication time coefficient") may be also taken into account to obtain the value of the deterioration coefficient K which is used in calculating the incremental deterioration amount. The element fabrication time coefficient may be taken into account in a case that a gray scale correction coefficient C(K) cannot be adjusted for each production lot or for each production condition, for example. When the element fabrication time coefficient is represented by a reference sign C(E), the value of the deterioration coefficient K can be obtained by using Equation (21), Equation (22), or Equation (23) below, for example (the gray scale BC correction coefficient C(KBC) described above may be used).

$$K=C(K)\times C(BC)\times C(T)\times C(E) \quad (21)$$

$$K=C(K)\times C(BC)\times C(E) \quad (22)$$

$$K=C(K)\times C(T)\times C(E) \quad (23)$$

Figure 19:
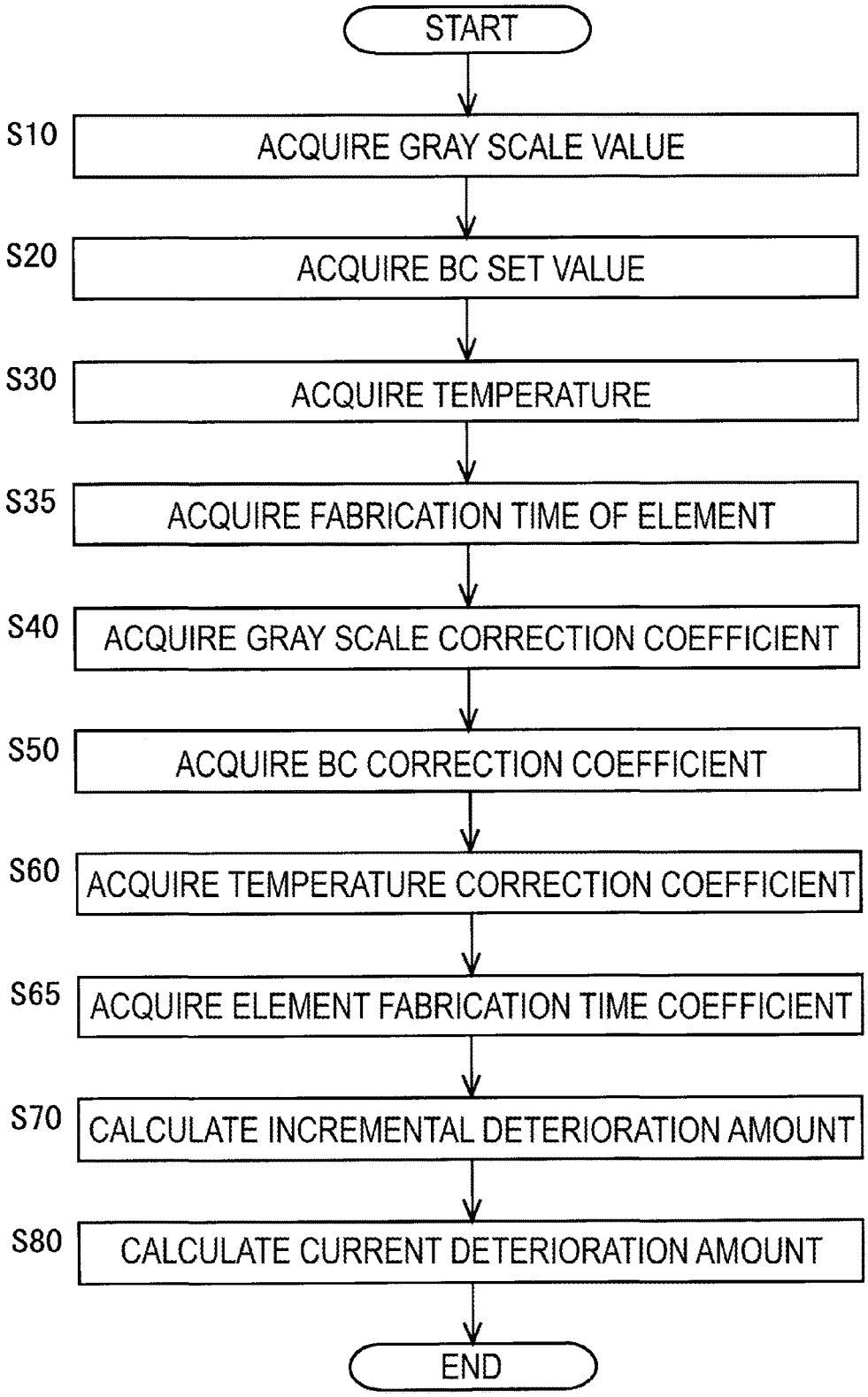
FIG. 19 is a flowchart illustrating a procedure for obtaining a total time deterioration amount of the organic EL element in a modification of the above embodiment.

For example, in the case that above Equation (21) is used to obtain the value of the deterioration coefficient K, as illustrated in FIG. 19, for example, step S35 for acquiring the element fabrication time and step S65 for acquiring the element fabrication time coefficient C(E) may be added to the procedure illustrated in FIG. 18

The value of the deterioration coefficient K is obtained taking into account also the length of the fabrication time of the organic EL element as described above, allowing the incremental deterioration amount per unit of time to be more accurately obtained. As a result, the image sticking caused by the deterioration of the organic EL element is more effectively inhibited from occurring.

5.2 Data Held in Total Time Deterioration Amount DB

In the above embodiment, the data of the total time deterioration amounts for the all pixels (all sub pixels) in the display unit 50 (that is, the total time deterioration amount for each sub pixel) is held in the total time deterioration amount DB 120. However, the disclosure is not limited to the above, but there may be formed groups for each P sub pixels (P is an integer equal to or greater than two) arranged at positions near each other (e.g., for every four sub pixels) to hold the data of the total time deterioration amount for each group. In multiple sub pixels of the same color arranged at the positions near each other, displaying at the gray scale of the same or near value is often performed and the temperatures are also approximately equal to each other. Therefore, even in such a case that the data of the total time deterioration amounts are held for each group (that is, for every multiple sub pixels), the gray scale values can be corrected with a relatively higher accuracy. This allows a required amount of memory to be reduced. Note that in the case of this configuration, the total time deterioration amount DB 120 may hold data obtained by techniques (first to third techniques) as described below, for example. Then, the gray scale value of each sub pixel may be corrected based on the held data.

First technique: similar to the above embodiment, the incremental deterioration amounts Δy' are obtained for the all sub pixels. Then, an average value of the incremental deterioration amounts Δy' is obtained for each group, and the average value is added to the total time deterioration amount y for each group.

Second technique: a representative sub pixel is determined in advance from among P sub pixels included in each group, and the incremental deterioration amount Δy' for the representative sub pixel is obtained similarly to the above embodiment. Then, the obtained incremental deterioration amount Δy' is added to the total time deterioration amount y for each group.

Third technique: an average value of the gray scale correction coefficients C(K) is obtained for each group on the basis of the gray scale correction coefficient C(K)

obtained for each sub pixel. In a case where information on the brightness setting and temperature can be obtained for each sub pixel, average values of the BC correction coefficients C(BC) and temperature correction coefficients C(T) are also obtained for each group in a similar way. Then, three values obtained for each group are multiplied together to obtain the deterioration coefficient for each group. The deterioration coefficient is used to obtain the incremental deterioration amount Δy' similarly to the above embodiment. Then, the obtained incremental deterioration amount Δy' is added to the total time deterioration amount y for each group.

Next, with reference to FIG. 20 to FIG. 24, a forming method of a group is described. Note that each of FIG. 20 to FIG. 24 illustrate an example in a case of an RGB arrangement. In FIG. 20 to FIG. 24, a rectangle representing the sub pixel is marked at a center thereof with a number for identifying a group to which the sub pixel belongs (group number). Note that a sub pixel marked with a group number including a character "R" is a red color sub pixel, a sub pixel marked with a group number including a character "G" is a green color sub pixel, and a sub pixel marked with a group number including a character "B" is a blue color sub pixel. Assume that each group consists of same color sub pixels. For example, a sub pixel marked with "R1" and a sub pixel marked with "R2" belong to different groups, and a sub pixel marked with "R2" and another sub pixel marked with "R2" belong to the same group. Moreover, a sub pixel marked with "R1" and a sub pixel marked with "G1" belong to different groups, for example. Hereinafter, the group number is treated as a reference sign.

Figure 20:
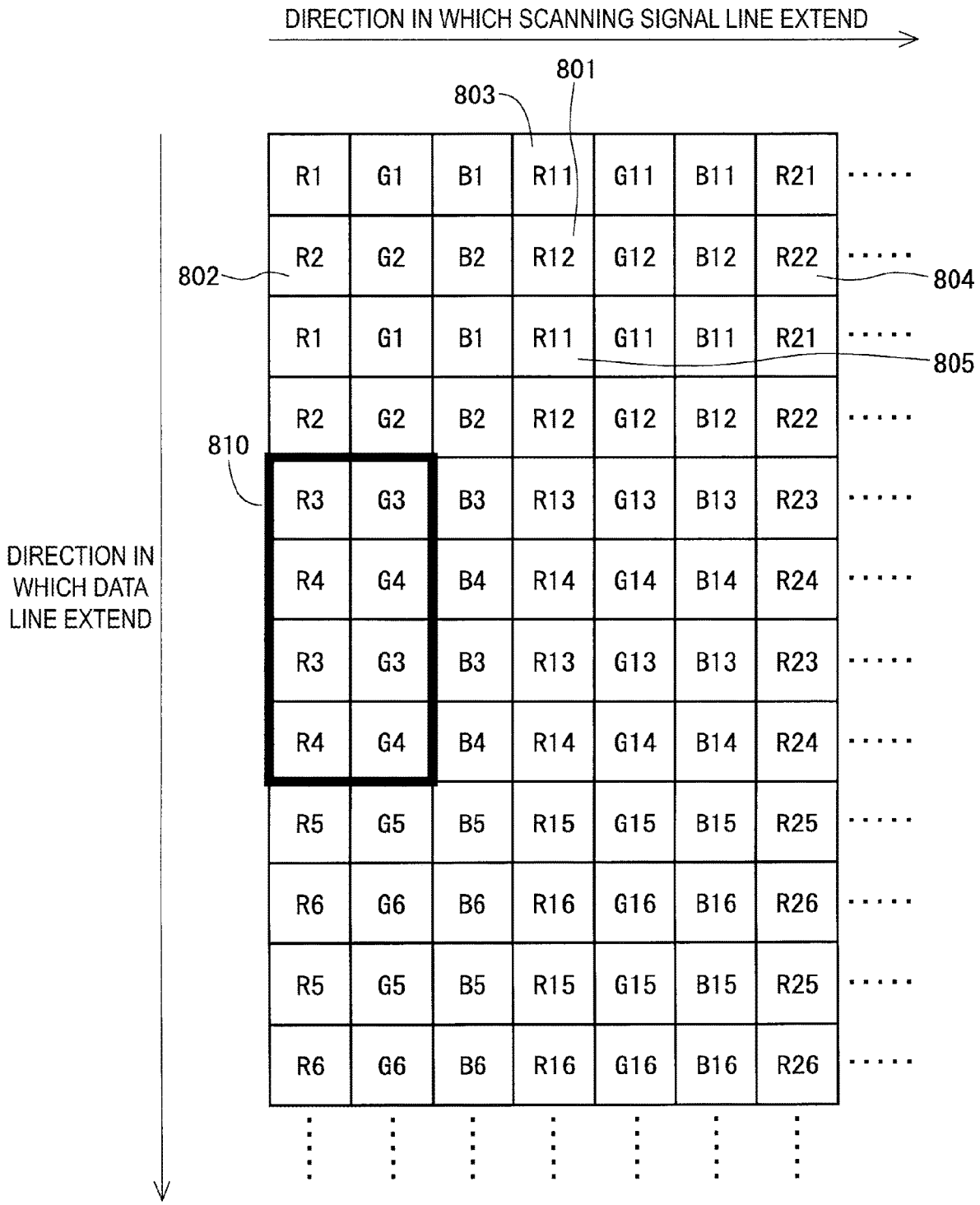
FIG. 20 a diagram illustrating an example of a forming method of a group in a modification of the above embodiment.

Groups are formed such that the same color sub pixels adjacent to each other belong to groups different from each other as illustrated in FIG. 20, for example. For example, focusing only on red color sub pixels, a sub pixel 801 is adjacent to four sub pixels 802 to 805. Here, the sub pixel 801 belongs to a group R12, whereas all of four sub pixels 802 to 805 do not belong to the group R12. In the example illustrated in FIG. 20, each group is formed of two sub pixels belonging to the same column (alternate sub pixels between which one sub pixel is interposed)

Figure 21:
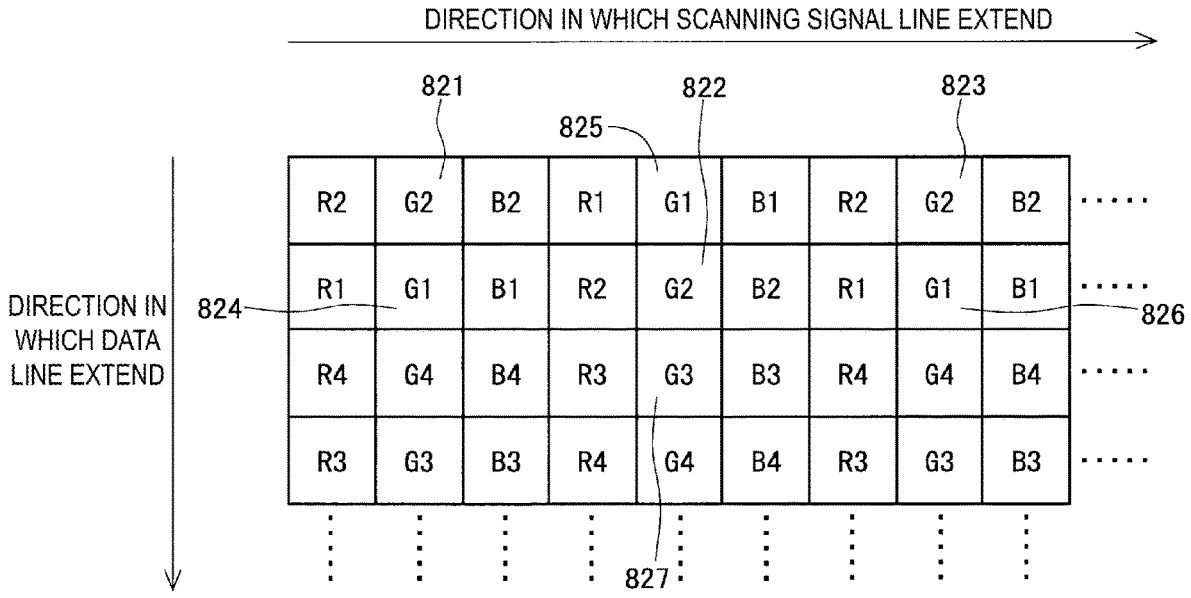
FIG. 21 a diagram illustrating an example of a forming method of a group in a modification of the above embodiment.

Each group consists of sub pixels belonging to the same column in the example illustrated in FIG. 20, but each group may be formed of multiple sub pixels belong to multiple columns, or each group may be formed of multiple sub pixels belonging to multiple rows. In this regard, FIG. 21 illustrates an example in which each group is formed of three sub pixels belonging to two rows and three columns. For example, a single group G2 is formed of sub pixels 821 to 823. Also in the example illustrated in FIG. 21, focusing only on green color sub pixels, for example, all of four sub pixels 824 to 827 adjacent to the sub pixel 822 does not belong to the group G2 to which the sub pixel 822 belongs.

In a case where grouping is performed such that the same color sub pixels adjacent to each other belong to the same group, it is concerned that block noises are to be generated (that is, continuity of the gray scale is lost at boundaries of the groups due to data being decimated) when an image is displayed. Therefore, the same color sub pixels adjacent to each other are grouped to belong to groups different from each other, as described above.

Figure 22:
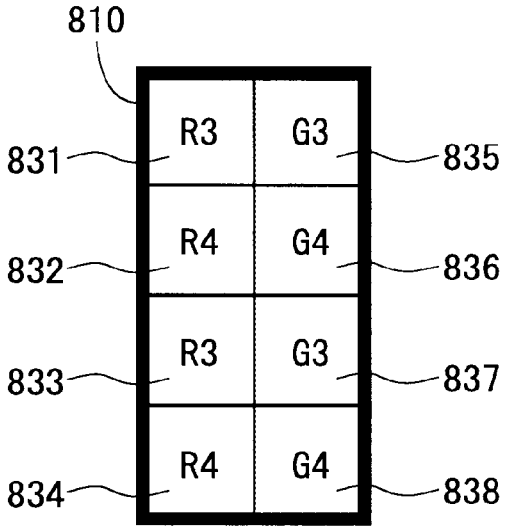
FIG. 22 is a diagram for describing a forming method of a group in a modification of the above embodiment.
Figure 23:
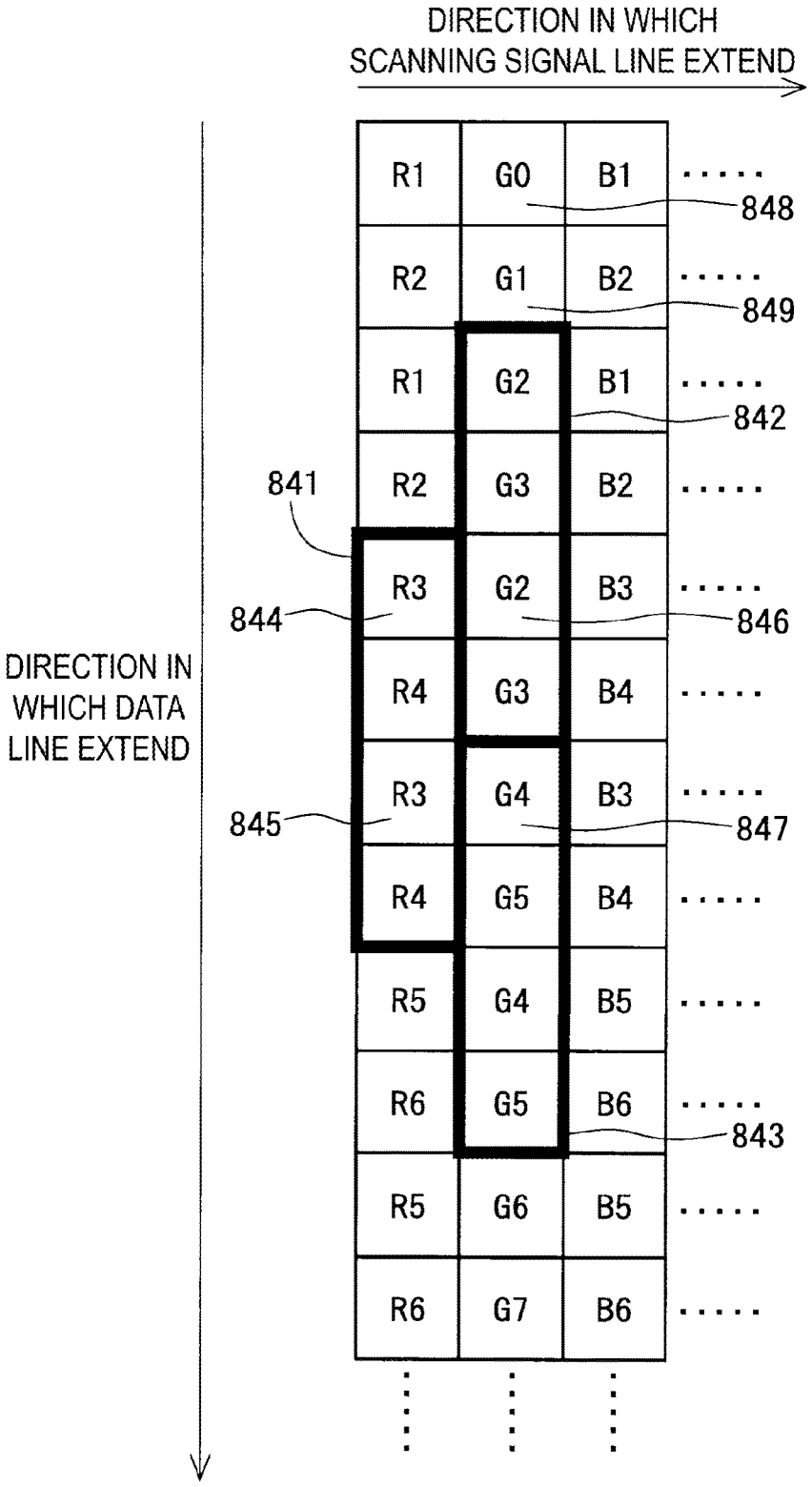
FIG. 23 a diagram illustrating an example of a forming method of a group in a modification of the above embodiment.
Figure 24:
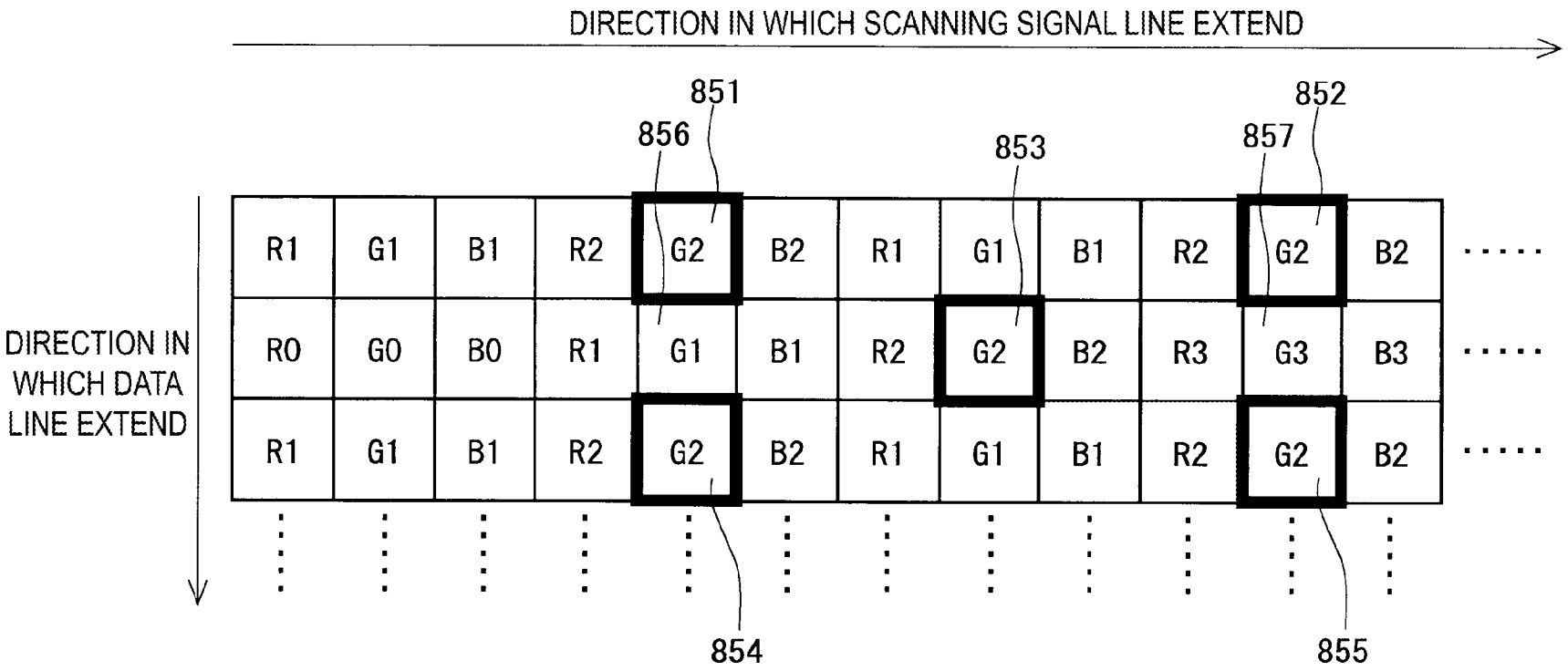
FIG. 24 a diagram illustrating an example of a forming method of a group in a modification of the above embodiment.

Here, focusing on a thick-frame part designated by a reference sign 810 in FIG. 20, for example, two sub pixels which are different in color from and adjacent to two sub pixels belonging to the same group belong to the same group. Specifically, as illustrated in FIG. 22, both a sub pixel 835 adjacent to a sub pixel 831 belonging to a group R3 and a sub pixel 837 adjacent to a sub pixel 833 belonging to the group R3 belong to a group G3. Similarly, both a sub pixel 836 adjacent to a sub pixel 832 belonging to a group R4 and a sub pixel 838 adjacent to a sub pixel 834 belonging to the group R4 belong to a group G4. In this regard, in order to further effectively inhibit the block noise from being generated, a block is desirably formed as illustrated in FIG. 23 or FIG. 24, for example. This is described below.

FIG. 23 illustrates an example in which each group is formed of two sub pixels belonging to the same column. Here, focus on thick-frame parts designated by reference signs 841 to 843 in FIG. 23. Each of the thick-frame parts 841 to 843 includes two groups each including two sub pixels. In the thick-frame part 841, a sub pixel 844 and a sub pixel 845 belong to the same group R3. Focusing on the groups to which sub pixels being different in color from and adjacent to those two sub pixels 844 and 845 belong, a sub pixel 846 different in color from and adjacent to the sub pixel 844 belongs to the group G2, whereas a sub pixel 847 different in color from and adjacent to the sub pixel 845 belongs to the group G4. FIG. 24 illustrates an example in which each group is formed of five sub pixels belonging to three rows and three columns. For example, five sub pixels 851 to 855 (sub pixels with thick-frames) form one group G2. Here, focusing on the groups to which sub pixels being adjacent to two sub pixels 851 and 852 arranged in a first row in those five sub pixels 851 to 855 belong, a sub pixel 856 adjacent to the sub pixel 851 belongs to a group G1, whereas a sub pixel 857 adjacent to the sub pixel 852 belongs to the group G3.

As described above, in the examples illustrated in FIG. 23 and FIG. 24, multiple sub pixels (pixel circuits) arranged in a line in a direction in which the scanning signal line or the data line extends are defined as a pixel line, any two pixel lines adjacent to each other are defined as a first pixel line and a second pixel line, and when focusing on a group including two or more sub pixels (pixel circuits) included in the first pixel line, two sub pixels (pixel circuits) belong to different groups, the two pixel circuits being included in the second pixel line and being adjacent to two sub pixels (pixel circuits) that belongs to the focused group and are arranged on one end side and the other end side of the first pixel line. Grouping performed in this way effectively inhibits the block noise from being generated.

5.3 Correction of Gray Scale Value

Figure 25:
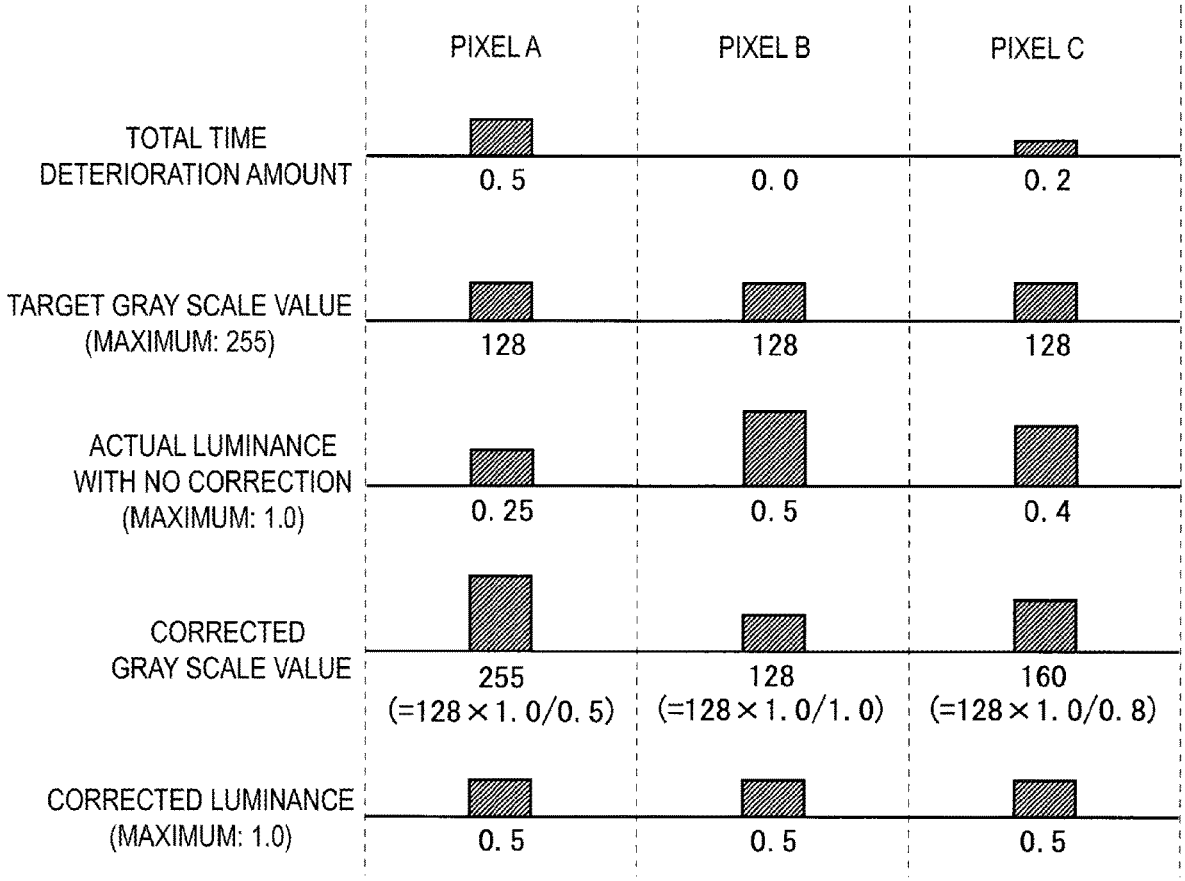
FIG. 25 is a diagram for describing how to correct a gray scale value in a modification of the above embodiment.
Figure 26:
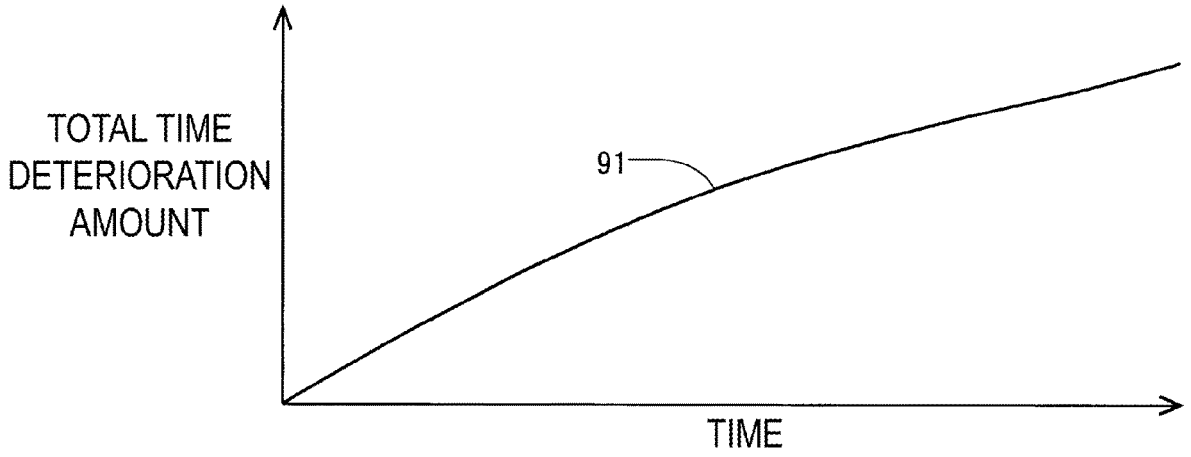
FIG. 26 is a graph for describing a relationship between an elapsed time and an amount of deterioration of an organic EL element accumulated with the elapsed time.

In the above embodiment, the gray scale value of the correction target pixel is corrected into a value smaller than the original gray scale value according to the deterioration degree of the organic EL element OLED included in the correction target pixel. In other words, the less the deterioration amount of the organic EL element OLED in a pixel, the smaller than original gray scale value the gray scale value of the pixel is corrected. However, the disclosure is not limited to the above, and the pixel including the deteriorated organic EL element OLED may be the correction target pixel such that the gray scale value of the correction target pixel is corrected to be heightened to obtain a target luminance. To be more specific, when an image generally low in luminance (that is an image of which gray scale value involves no overflow even in a case where the gray scale value is corrected to be heightened) is displayed, the gray scale value may be corrected in such a way that the larger relatively the deterioration amount of the organic EL element OLED, the larger the gray scale value of the digital video signal DV corresponding to the pixel circuit 52 including the organic EL element OLED as compared with the corresponding gray scale value of the input image signal DIN. With reference to FIG. 25, a description is given below of how to correct the gray scale value.

As illustrated in FIG. 25, assume that the target gray scale value (gray scale value of the input image signal DIN) is 128 (maximum gray scale value is 255) in the all pixels. At that occasion, with the total time deterioration amount of each pixel being taken into account, in a case where the gray scale values are not corrected, a luminance of the pixel A is 0.25, a luminance of the pixel B is 0.5, and a luminance of the pixel C is 0.4 (note that a maximum value of luminance is assumed to be 1.0). Here, in this modification, the corrected gray scale value V2 of each correction target pixel is calculated by using Equation (24) below:

$$V2=V1\times(1/(1-Dt)) \quad (24)$$

where, V1 represents the target gray scale value of the correction target pixel, and Dt represents the total time deterioration amount of the correction target pixel.

According to above Equation (24), the corrected gray scale value of the pixel A is 255, the corrected gray scale value of the pixel B is 128, and the corrected gray scale value of the pixel C is 160. As a result, taking into account the total time deterioration amount of each pixel, the luminance of the all pixels is 0.5. With this constitution, in a case where the target gray scale values of multiple pixels are the same, the organic EL elements OLEDs in those multiple pixels light at the same luminance. In this way, similarly to the above embodiment, the image sticking is prevented from occurring also in the modification.

Therefore, it is preferable to, taking into account the gamma characteristics of the panel, calculate the corrected gray scale value V2 of each correction target pixel using Equation (25) below instead of above Equation (24):

$$V2=(L1/(1-Dt))^{1/\gamma}\times V\max^{\gamma} \quad (25)$$

where, γ represents a gamma value of the organic EL panel 5, Vmax represents a maximum gray scale value (that is 255, here), and L1 represents a luminance corresponding to the target gray scale value and obtained by $(V1/V\max)^{\gamma}$.

5.4 Mounting Location of Deterioration Compensation Processing Unit

In the above embodiment, the deterioration compensation processing unit 100 is provided inside the display control circuit 10. However, the disclosure is not limited to the above, and a configuration in which the deterioration compensation processing unit 100 is provided inside the source driver 20 can be also adopted.

REFERENCE SIGNS LIST

5 Organic EL panel
10 Display control circuit
20 Source driver
30 Gate driver
40 Emission driver
50 Display unit
100 Deterioration compensation processing unit
110 Image deterioration correction unit
120 Total time deterioration amount DB (database)
130 Total time deterioration amount update unit
131 Gray scale correction coefficient calculation unit
132 BC correction coefficient calculation unit
133 Temperature correction coefficient calculation unit
134 Incremental deterioration amount table
135 Incremental deterioration calculation unit
136 Data update unit

The invention claimed is:

1. An organic EL display device provided with multiple pixel circuits including organic EL elements, the organic EL display device comprising:

a deterioration amount holding unit configured to hold a deterioration amount of at least one organic EL element among the organic EL elements included in a pixel circuit among the multiple pixel circuits;

a deterioration amount update unit configured to obtain an incremental deterioration amount of the organic EL element included in the pixel circuit taking into account a gray scale value of a video signal and at least one of a set value for brightness adjustment and a temperature, and add the obtained incremental deterioration amount to the deterioration amount held in the deterioration amount holding unit; and a gray scale value correction unit configured to correct the gray scale value, based on the deterioration amount held in the deterioration amount holding unit when generating the video signal from an input signal, wherein, at the deterioration amount update unit, obtaining the incremental deterioration amount of the organic EL element included in the pixel circuit further includes taking into account a time having required to fabricate the organic EL element, the deterioration amount update unit is further configured to obtain the incremental deterioration amount of the organic EL element included in the pixel circuit, based on of a deterioration coefficient and the deterioration amount held in the deterioration amount holding unit, the deterioration coefficient being obtained by multiplying a gray scale correction coefficient determined based on the gray scale value of the video signal, a brightness correction coefficient determined based on the set value for brightness adjustment, and a temperature correction coefficient determined based on the temperature together, the deterioration amount update unit includes an incremental deterioration amount calculation look-up table holding a relationship between the deterioration amount and the incremental deterioration amount, the incremental deterioration amount calculation look-up table being referred to in obtaining the incremental deterioration amount of the organic EL element included in the pixel circuit, the relationship held in the incremental deterioration amount calculation look-up table is expressed by an equation:

$$\Delta y=g(y)$$

where, Δy represents the incremental deterioration amount, y represents the deterioration amount, and g represents a function with y as an argument, and the deterioration amount update unit is further configured to refer to the incremental deterioration amount calculation look-up table to obtain the incremental deterioration amount of the organic EL element included in the pixel circuit by using an equation:

$$\Delta y'=K\cdot g((1/K)\cdot y)$$

where, Δy' represents the incremental deterioration amount of a target organic EL element, K represents the deterioration coefficient corresponding to the target organic EL element, and y represents the deterioration amount of the target organic EL element held in the deterioration amount holding unit.

2. The organic EL display device according to claim 1, wherein the gray scale value correction unit is further configured to correct the gray scale value of the video signal corresponding to the pixel circuit including the organic EL element to be smaller as compared with a gray scale value of the input signal, as the deterioration amount of the organic EL element is relatively smaller.

3. The organic EL display device according to claim 1, wherein the gray scale value correction unit is further configured to correct the gray scale value of the video signal corresponding to the pixel circuit including the organic EL element to be larger as compared with a gray scale value of the input signal, as the deterioration amount of the organic EL element is relatively larger.

4. The organic EL display device according to claim 1, wherein the deterioration amount holding unit is further configured to hold the deterioration amount of the organic EL element included in the pixel circuit for each of all the multiple pixel circuits.

5. The organic EL display device according to claim 1, wherein data of the deterioration amount held in the deterioration amount holding unit includes data for each group, the group including P pixel circuits, P being an integer equal to or greater than two.

6. The organic EL display device according to claim 5, wherein when focusing on pixel circuits corresponding to any one color, two pixel circuits adjacent to each other belong to different groups.

7. An organic EL display device provided with multiple pixel circuits including organic EL elements, the organic EL display device comprising:

a deterioration amount holding unit configured to hold a deterioration amount of at least one organic EL element among the organic EL elements included in a pixel circuit among the multiple pixel circuits;

a deterioration amount update unit configured to obtain an incremental deterioration amount of the organic EL element included in the pixel circuit taking into account a gray scale value of a video signal and at least one of a set value for brightness adjustment and a temperature, and add the obtained incremental deterioration amount to the deterioration amount held in the deterioration amount holding unit; and a gray scale value correction unit configured to correct the gray scale value, based on the deterioration amount held in the deterioration amount holding unit when generating the video signal from an input signal, wherein at the deterioration amount update unit, obtaining the incremental deterioration amount of the organic EL element included in the pixel circuit further includes taking into account a time having required to fabricate the organic EL element, the deterioration amount update unit is further configured to obtain the incremental deterioration amount of the organic EL element included in the pixel circuit, based on a deterioration coefficient and the deterioration amount held in the deterioration amount holding unit, the deterioration coefficient being obtained by multiplying a gray scale correction coefficient determined based on the gray scale value of the video signal and a brightness correction coefficient determined based on the set value for brightness adjustment together, the deterioration amount update unit includes an incremental deterioration amount calculation look-up table holding a relationship between the deterioration amount and the incremental deterioration amount, the incremental deterioration amount calculation look-up table being referred to in obtaining the incremental deterioration amount of the organic EL element included in the pixel circuit, the relationship held in the incremental deterioration amount calculation look-up table is expressed by an equation:

$$\Delta y = g(y)$$

where, Δy represents the incremental deterioration amount, y represents the deterioration amount, and g represents a function with y as an argument, and the deterioration amount update unit is further configured to refer to the incremental deterioration amount calculation look-up table to obtain the incremental deterioration amount of the organic EL element included in the pixel circuit by using an equation:

$$\Delta y' = K \cdot g((1/K) \cdot y)$$

where, Δy' represents the incremental deterioration amount of a target organic EL element, K represents the deterioration coefficient corresponding to the target organic EL element, and y represents the deterioration amount of the target organic EL element held in the deterioration amount holding unit.

8. The organic EL display device according to claim 7, wherein the gray scale value correction unit is further configured to correct the gray scale value of the video signal corresponding to the pixel circuit including the organic EL element to be smaller as compared with a gray scale value of the input signal, as the deterioration amount of the organic EL element is relatively smaller.

9. The organic EL display device according to claim 7, wherein the gray scale value correction unit is further configured to correct the gray scale value of the video signal corresponding to the pixel circuit including the organic EL element to be larger as compared with a gray scale value of the input signal, as the deterioration amount of the organic EL element is relatively larger.

10. The organic EL display device according to claim 7, wherein the deterioration amount holding unit is further configured to hold the deterioration amount of the organic EL element included in the pixel circuit for each of all the multiple pixel circuits.

11. The organic EL display device according to claim 7, wherein data of the deterioration amount held in the deterioration amount holding unit includes data for each group, the group including P pixel circuits, P being an integer equal to or greater than two.

12. The organic EL display device according to claim 11, wherein when focusing on pixel circuits corresponding to any one color, two pixel circuits adjacent to each other belong to different groups.

13. An organic EL display device provided with multiple pixel circuits including organic EL elements, the organic EL display device comprising:

a deterioration amount holding unit configured to hold a deterioration amount of at least one organic EL element among the organic EL elements included in a pixel circuit among the multiple pixel circuits;

a deterioration amount update unit configured to obtain an incremental deterioration amount of the organic EL element included in the pixel circuit taking into account a gray scale value of a video signal and at least one of a set value for brightness adjustment and a temperature, and add the obtained incremental deterioration amount to the deterioration amount held in the deterioration amount holding unit; and a gray scale value correction unit configured to correct the gray scale value, based on the deterioration amount held in the deterioration amount holding unit when generating the video signal from an input signal, wherein at the deterioration amount update unit, obtaining the incremental deterioration amount of the organic EL element included in the pixel circuit further includes taking into account a time having required to fabricate the organic EL element, the deterioration amount update unit is further configured to obtain the incremental deterioration amount of the organic EL element included in the pixel circuit, based on a deterioration coefficient and the deterioration amount held in the deterioration amount holding unit, the deterioration coefficient being obtained by multiplying a gray scale correction coefficient determined based on the gray scale value of the video signal and a temperature correction coefficient determined based on the temperature together, the deterioration amount update unit includes an incremental deterioration amount calculation look-up table holding a relationship between the deterioration amount and the incremental deterioration amount, the incremental deterioration amount calculation look-up table being referred to in obtaining the incremental deterioration amount of the organic EL element included in the pixel circuit, the relationship held in the incremental deterioration amount calculation look-up table is expressed by an equation:

$$\Delta y = g(y)$$

where, Δy represents the incremental deterioration amount, y represents the deterioration amount, and g represents a function with y as an argument, and the deterioration amount update unit is further configured to refer to the incremental deterioration amount calculation look-up table to obtain the incremental deterioration amount of the organic EL element included in the pixel circuit by using an equation:

$$\Delta y' = K \cdot g((1/K) \cdot y)$$

where, Δy' represents the incremental deterioration amount of a target organic EL element, K represents the deterioration coefficient corresponding to the target organic EL element, and y represents the deterioration amount of the target organic EL element held in the deterioration amount holding unit.

14. The organic EL display device according to claim 13, wherein the gray scale value correction unit is further configured to correct the gray scale value of the video signal corresponding to the pixel circuit including the organic EL element to be smaller as compared with a gray scale value of the input signal, as the deterioration amount of the organic EL element is relatively smaller.

15. The organic EL display device according to claim 13, wherein the gray scale value correction unit is further configured to correct the gray scale value of the video signal corresponding to the pixel circuit including the organic EL element to be larger as compared with a gray scale value of the input signal, as the deterioration amount of the organic EL element is relatively larger.

16. The organic EL display device according to claim 13, wherein the deterioration amount holding unit is further configured to hold the deterioration amount of the organic EL element included in the pixel circuit for each of all the multiple pixel circuits.

17. The organic EL display device according to claim 13, wherein data of the deterioration amount held in the deterioration amount holding unit includes data for each group, the group including P pixel circuits, P being an integer equal to or greater than two.

18. The organic EL display device according to claim 17, wherein when focusing on pixel circuits corresponding to any one color, two pixel circuits adjacent to each other belong to different groups.

* * * * *